US007661288B2

(12) United States Patent
Shimota et al.

(10) Patent No.: US 7,661,288 B2
(45) Date of Patent: Feb. 16, 2010

(54) PRESS BRAKE TOOL SAFETY KEY ASSEMBLIES

(75) Inventors: Jon M. Shimota, Stillwater, MN (US); Bryan L. Rogers, Forest Lake, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 428 days.

(21) Appl. No.: 11/616,602

(22) Filed: Dec. 27, 2006

(65) Prior Publication Data

US 2007/0144232 A1 Jun. 28, 2007

Related U.S. Application Data

(63) Continuation-in-part of application No. 11/361,604, filed on Feb. 24, 2006, now abandoned, which is a continuation of application No. 10/611,181, filed on Jul. 1, 2003, now Pat. No. 7,004,008.

(51) Int. Cl.
*B21D 37/04* (2006.01)
*B21D 5/02* (2006.01)

(52) U.S. Cl. ..... 72/482.1; 72/481.1

(58) Field of Classification Search ..... 72/389.3, 72/389.4, 389.6, 481.1, 481.2, 482.1, 482.6, 72/482.91, 482.92
See application file for complete search history.

(56) References Cited

U.S. PATENT DOCUMENTS

| | | | |
|---|---|---|---|
| 2,755,758 | A | 7/1956 | Johansen |
| 3,779,122 | A | 12/1973 | Sawvell |
| 4,534,203 | A | 8/1985 | Cros |
| 4,787,237 | A | 11/1988 | Houston |
| 4,993,255 | A | 2/1991 | Treillet |
| 5,009,098 | A | 4/1991 | Van Merksteijn |
| 5,042,352 | A | 8/1991 | Lux |
| 5,245,854 | A | 9/1993 | Bruggink |
| 5,460,027 | A | 10/1995 | Takahashi |
| 5,642,642 | A | 7/1997 | Kawano |
| 5,782,308 | A | 7/1998 | Latten |
| 5,794,486 | A | 8/1998 | Sugimoto |
| 6,003,360 | A | 12/1999 | Runk |
| 6,138,492 | A | 10/2000 | Vining |
| 6,463,839 | B2 | 10/2002 | Ohtsuka |
| 6,467,327 | B1 | 10/2002 | Runk |
| 6,494,075 | B1 | 12/2002 | Pelech, Jr. |

(Continued)

FOREIGN PATENT DOCUMENTS

| | | |
|---|---|---|
| AT | 13832002 | 11/2003 |

(Continued)

*Primary Examiner*—David B Jones
(74) *Attorney, Agent, or Firm*—Fredrikson & Byron, P.A.

(57) ABSTRACT

The invention provides a press brake tool having a retractable safety key. In some embodiments, the tool includes a lock that can positively lock the safety key in an extended position. Different lock assemblies of this nature are provided. Also provided is a combination including a press brake tool and a tool holder. In some embodiments, the invention provides a press brake tool having a retractable safety key with an engagement portion having a tapered leading region (adapted to facilitate mounting the tool in a recess of a tool holder) and a tapered trailing region (adapted to facilitate dismounting the tool from the recess of the tool holder). Methods of use are also provided.

20 Claims, 29 Drawing Sheets

U.S. PATENT DOCUMENTS

| | | | | |
|---|---|---|---|---|
| 6,644,090 | B2 | 11/2003 | Gasparini | |
| 6,732,564 | B2 | 5/2004 | Runk | |
| 6,928,852 | B2 | 8/2005 | Enderink | |
| 7,004,008 | B2 | 2/2006 | Harrington | |
| 7,021,116 | B2 | 4/2006 | Harrington | |
| 7,308,817 | B2 * | 12/2007 | Shimota et al. | 72/482.1 |

FOREIGN PATENT DOCUMENTS

| | | |
|---|---|---|
| DE | 3136440 | 3/1983 |
| DE | 4115224 | 11/1992 |
| DE | 19513576 | 10/1996 |
| DE | 19845386 | 5/2000 |
| DE | 10054644 | 5/2001 |
| EP | 0119108 | 5/1987 |
| EP | 0237800 | 9/1987 |
| EP | 0256245 | 2/1988 |
| FR | 2122977 | 8/1972 |
| FR | 2416064 | 8/1979 |
| FR | 2598946 | 11/1987 |
| RU | 741999 | 11/1977 |
| WO | 2004024361 | 3/2004 |

* cited by examiner

PRESS BRAKE TOOL SAFETY KEY ASSEMBLIES

RELATED APPLICATIONS

This application is a continuation-in-part of U.S. patent application Ser. No. 11/361,604, filed Feb. 24, 2006, titled Press Brake Tool Having Lockable Safety Key, which is a continuation of U.S. patent application Ser. No. 10/611,181, filed Jul. 1, 2003, also titled Press Brake Tool Having Lockable Safety Key, now issued as U.S. Pat. No. 7,004,008, the entire teachings of each of which are incorporated herein by reference.

FIELD OF THE INVENTION

The present invention relates generally to press brake tools. More particularly, this invention relates to press brake tools that have safety keys.

BACKGROUND OF THE INVENTION

Press brakes are commonly used to shape sheet-like workpieces, such as sheet metal and the like. A conventional press brake has an upper beam and a lower beam, at least one of which is movable toward and away from the other. Typically, the upper beam is movable vertically while the lower beam is fixed in a stationary position. It is common for a male forming punch and a female forming die to be mounted respectively on the upper and lower beams of a press brake.

Typically, the male forming punch has a downwardly-oriented, workpiece-deforming surface (or "tip"). The configuration of this surface is dictated by the shape into which it is desired to bend a workpiece. The forming die typically has a recess that is aligned with the tip of the punch. The configuration of this recess corresponds to the configuration of the workpiece-deforming surface of the punch. Thus, when the beams are brought together, a workpiece between the two is pressed by the punch into the die to give the workpiece a desired bend.

It is often necessary to exchange forming punches and dies when different bending operations are to be performed. Generally, dies mounted on the lower beam of a press brake are readily removed and exchanged for others. However, punches mounted on the upper table of a press brake often are not so easily replaced. For example, in some applications, punches are secured to the upper beam by a clamp. Once the clamp has been loosened, the punch in some cases is removed downwardly, but in other cases must be removed horizontally (i.e., by sliding the punch longitudinally from the clamp). When the clamp is loosened to the point where the punch can be removed downwardly, the punch may accidentally slip and fall. This can cause harm to press brake operators and/or damage to equipment, particularly when using long punches (which can be quite heavy).

A common press brake tool holder design is known as the "American style" and is shown schematically in FIG. 1A with a common American-style press brake punch. As shown in this figure, the bottom portion of the upper beam is so fashioned as to include a plate C, and a heavy bolt BO is employed to attach the plate to the beam TA. The beam and plate have confronting surfaces that bound a downwardly-open recess 8 into which the tang T of the punch TL is received. Typically, the bottom surfaces B of the beam and plate are horizontally aligned and serve as load bearing surfaces for transmitting a downwardly-directed load onto the upwardly-facing shoulders SH of the punch TL.

To mount an American-style punch in a corresponding tool holder, the punch is pushed upwardly into the downwardly-open recess 8 until the load receiving shoulders SH of the punch encounter the load-transmitting surfaces B of the plate C and beam TA. The bolt BO is then tightened to secure the tang T of the punch TL between the plate C and the beam TA. When the punch is to be removed from the holder, the plate C is loosened and the punch, while gripped firmly by the operator, is withdrawn downwardly. To avoid the possibility of accidentally dropping the punch, the top of the tang may have an integral projection that extends into a safety groove of the holder. With this arrangement, however, the tool must be mounted and dismounted by moving it horizontally.

U.S. Pat. No. 6,467,327 (Runk et al.), the entire contents of which are incorporated herein by reference, provides-American-style tooling having a particularly advantageous safety mechanism. A tool holder described in this patent ("the '327 patent") has walls defining a downwardly-open, tool-receiving recess. The walls of the tool holder define both a downwardly-facing, force-delivering shoulder adjacent the bottom of the tool-receiving recess and a shelf within the recess having an upwardly-facing surface that is spaced upwardly from the downwardly-facing, force-delivering shoulder. The tool comprises a body having a lower workpiece-engaging surface, an upwardly-facing, force-receiving shoulder engageable with the shoulder of the tool holder, and an upwardly-extending tang receivable in the tool holder's downwardly open recess. The tool includes an actuator that is spaced below the tool's force-receiving shoulder. A safety key is coupled to the actuator for movement horizontally into and out of alignment with the tool holder's shelf. Thus, the '327 patent provides a highly advantageous American-style tool that can be removed downwardly from the tool holder and yet offers the ability to loosen the clamp (or "plate") on the tool holder without risking immediate dropping of the tool.

FIG. 1C depicts another style of tooling that is commonly referred to as Wila-style tooling. Characteristically, a Wila-style tool holder has a horizontally-extending safety slot S/S, and a Wila-style tool has a movable projection P that, in use, extends outwardly through an opening in the side surface of the tang tool into the safety slot. Reference is made to U.S. Pat. No. 5,245,854, the entire teachings of which are incorporated herein by reference, for additional details on Wila-style tools and tool holders.

As described in the aforementioned patents, a safety key can be moved into engagement with a tool holder by a spring that biases the safety key toward an extended position, and the safety key can be disengaged from the tool holder (and moved to a retracted position) by operating an actuator on the tool. For example, a button on the tool can be depressed to move the safety key toward the retracted position (against the bias of the spring). Thus, the spring alone keeps the safety key in its extended position. This is less than ideal in some respects. For example, when a tool is being positioned or repositioned on a tool holder (e.g., when sliding the tool along the tool holder), it may be difficult to assure the spring will keep the safety key engaged with the tool holder at all times. This may be particularly difficult to assure if the spring force weakens substantially over time. Press brake operators are thus required to carefully position and reposition such tools on a tool holder in case the safety key is inadvertently retracted during such movement of the tool in the tool holder. Inadvertent retraction of the safety key may otherwise cause the tool to fall unexpectedly from the tool holder. Thus, it would be desirable to provide a tool having a safety key that is movable between extended and retracted positions and that can be locked in its extended position.

More generally, it would be desirable to provide press brake tool safety key systems that facilitate advantageous manners of mounting the tool in a tool holder, locking the extended safety key of a mounted tool, and/or dismounting the tool from the tool holder in a safe, controlled fashion.

SUMMARY OF THE INVENTION

Certain embodiments of the invention provide a press brake tool and a tool holder in combination. In the present embodiments, the tool has a shank mounted in a downwardly-facing recess of the tool holder. The tool includes a safety key having an extended position and a retracted position. In the present embodiments, the safety key is in its extended position and is received in a safety groove of the tool holder. The safety groove is bounded by a generally upwardly-facing shoulder of the tool holder. In the present embodiments, the safety key has a tapered leading region with a leading cam surface, and a tapered trailing region with a trailing cam surface. The leading cam surface is offset from vertical by a leading angle, the trailing cam surface is offset from the vertical by a trailing angle, and the leading angle is smaller than the trailing angle. In the present embodiments, the tool includes a lock that is in a locked position such that the safety key is positively locked in its extended position. Further, in the present embodiments, the tool has a button that can be pushed by a press brake operator so as to move the lock from its locked position to an unlocked position. In these embodiments, pushing the button results in the safety key's trailing cam surface resting on the generally upwardly-facing shoulder so as to hold/maintain the tool in the tool holder's recess until the operator pulls downwardly on the tool so as to cause the safety key's trailing cam surface to cam with said generally upwardly-facing shoulder thereby moving the safety key from its extended position toward its retracted position and allowing the tool to be removed downwardly from the tool holder's recess.

In certain embodiments, the invention provides a press brake tool that is adapted to be mounted in a recess of a tool holder. In the present embodiments, the press brake tool comprises a safety key having an extended position and a retracted position. In the present embodiments, the safety key includes (a) a tapered leading region defining a leading cam surface that is adapted to cam with a first surface of the tool holder when the tool is inserted vertically into the recess thereby moving the safety key from its extended position to its retracted position and (b) a tapered trailing region defining a trailing cam surface that is adapted to cam with a second surface of the tool holder when the tool is removed vertically from the recess thereby moving the safety key from its extended position to its retracted position. In some cases, the leading cam surface is offset from vertical by a leading angle, the trailing cam surface is offset from the vertical by a trailing angle, and the leading and trailing angles are different.

Certain embodiments of the invention provide a press brake tool with a shank on which there is provided a safety key having an extended position and a retracted position. In the present embodiments, the safety key defines a recess and an aperture. The aperture extends through the safety key and is open to the recess. In the present embodiments, the tool has a lock assembly adapted for positively locking the safety key in its extended position. The lock assembly comprises a transfer member and an actuator. The transfer member has a base portion and an extending portion. The extending portion passes through the aperture defined by the safety key. Preferably, the actuator is operable to move the transfer member from (a) a locked position in which the base portion of the transfer member nests in the recess defined by the safety key (the safety key being positively locked in its extended position when the transfer member is in its locked position), to (b) an unlocked position in which the base portion is separated from the recess defined by the safety key (the safety key being permitted to move between its extended and retracted positions when the transfer member is in its unlocked position).

Further, certain embodiments of the invention provide a press brake tool that is adapted to be mounted in a recess of a tool holder. In the present embodiments, the press brake tool comprises a safety key and a lock assembly. The safety key has an extended position and a retracted position. The safety key defines a recess and an aperture. The aperture extends through the safety key and is open to the recess. The safety key includes a tapered leading region and a tapered trailing region. The tapered leading region preferably comprises a generally planar surface, which forms an acute, positive angle with horizontal (optionally between about 50° and about 60°). The tapered trailing region preferably comprises a generally planar surface, which forms an acute, negative angle with horizontal (optionally between about −15° and about −25°). In the present embodiments, the lock assembly includes a transfer member, an actuator, and a spring. The transfer member has a base portion and an extending portion, which passes through the aperture defined by the safety key. In the present embodiments, the actuator has a cam surface configured to cam with the extending portion of the transfer member such that a desired movement of the actuator causes the transfer member to move from (A) a locked position in which the base portion of the transfer member nests in the recess defined by the safety key (the safety key being positively locked in its extended position when the transfer member is in its locked position), to (B) an unlocked position in which the base portion is separated from the recess defined by the safety key (the safety key being permitted to move between its extended and retracted positions when the transfer member is in its unlocked position). The spring is configured to bias the transfer member toward its locked position.

DETAILED DESCRIPTION OF PREFERRED EMBODIMENTS

Figure 1C:
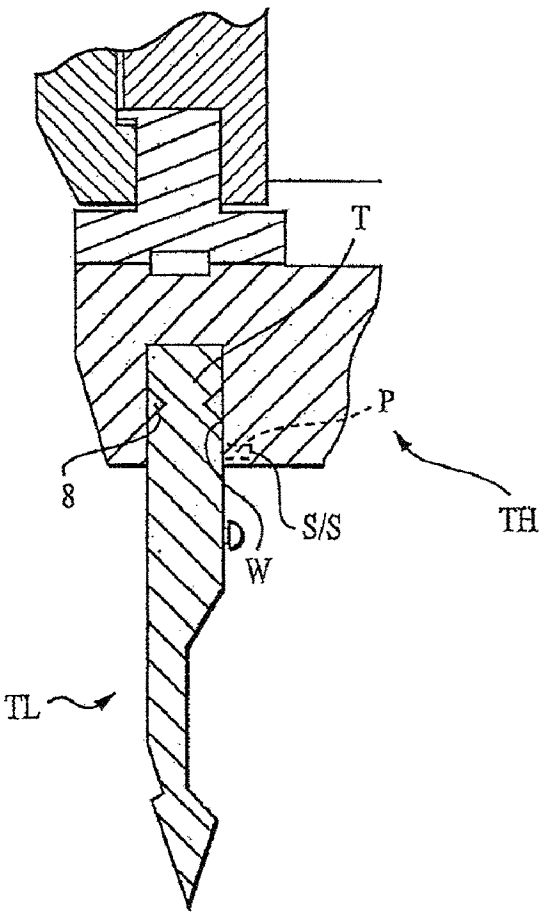
FIG. 1C is a schematic side view, partially broken away, of a press brake tool and tool holder of the Wila style.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

Figure 1B:
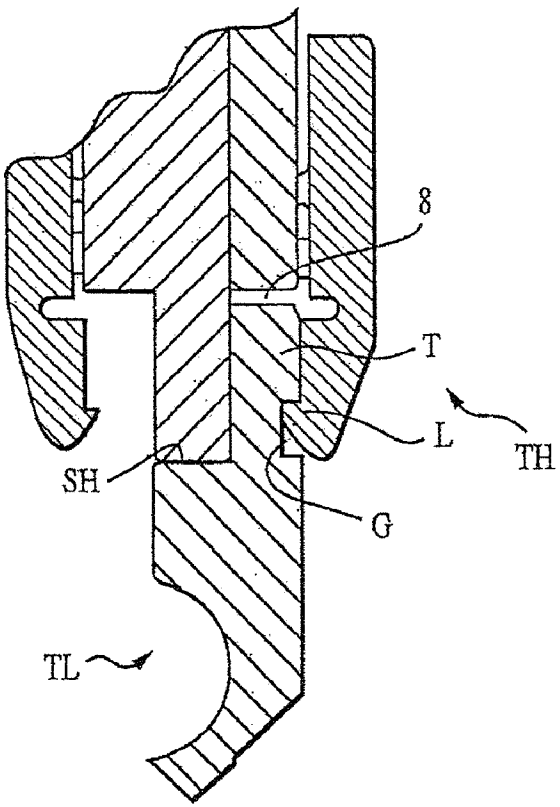
FIG. 1B is a schematic side view, partially broken away, of a press brake tool and tool holder of the European style.

The invention provides a press brake tool that has a lockable safety key. The press brake tool can be of any desired tooling style, including well-known styles such as the American, Wila, and European styles. The American and Wila styles are described above and illustrated respectively in FIGS. 1A and 1C. The European style, which is also well known in the present art, is illustrated in FIG. 1B. The press brake tool can also take the form of various other tooling styles that are known in the art but are currently in less widespread use. In fact, it will be appreciated that the press brake tool can be of essentially any desired tooling style, including styles not yet developed, that would benefit from having a lockable safety key.

The press brake tool is adapted to be mounted in a tool holder. The tool holder will commonly be of the American, Wila, or European styles. Thus, the tool holder of course can be a press brake beam (of an upwardly-acting press brake or a downwardly-acting press brake), an adaptor mounted to a press brake beam, or the like. Typically, the tool has a portion (e.g., a tang) that is configured to be received in a tool holder. For example, the tool commonly has a tang that is adapted to be mounted in the tool holder. In more detail, the tang is commonly sized and shaped to be mounted (e.g., snuggly received such that the tang is held rigidly) in a recess defined by the tool holder. In the illustrated embodiments, the tang T is at one end of the tool and a workpiece-deforming surface (or "tip") is at another end. Typically, the tang and the tip are at generally-opposed ends of the tool. In FIGS. 3A, 3B, 3C, 4A, 4B, 4C, 9A, 9B, and 10, the tang has two opposed sides each having therein formed a groove. The specific configuration of the tool will vary with different embodiments. The term "tool" is used herein to refer to male forming punches and female forming dies.

The tool includes a safety key that is movable between an extended position and a retracted position. Preferably, the safety key is moveable laterally (i.e., along the axis indicated by arrow LA, as is perhaps best appreciated with reference to FIG. 2I) between its extended and retracted positions. When the safety key is in the extended position, it is adapted to engage the tool holder to facilitate retention of the tool in the tool holder. Thus, when the safety key 50 is in the extended position, the distal end 59 of the safety key is further (e.g., laterally) from the tool tang T than when the safety key is in the retracted position. This can be appreciated by comparing FIG. 2G (which depicts one particular safety key in its retracted position) with FIG. 2H (which depicts the same safety key in its extended position). Preferably, the distal end 59 of the safety key 50 when in the extended position is further laterally from the tang T than it is when the safety key is in any other position within its range of movement. That is, the safety key 50 when in its extended position preferably is fully extended from the tang T. This facilitates full engagement of the safety key to the tool holder.

When the safety key is in the retracted position, it is adapted for being disengaged from the tool holder. Thus, when the safety key 50 is in the retracted position, the distal end 59 of the safety key is closer (e.g., laterally) to the tang T than when the safety key is in the extended position. In certain embodiments, the safety key 50 is retracted inside the tang T (or at least substantially inside the tang) when the safety key is in the retracted position. This will typically be preferred in Wila-style embodiments and other embodiments wherein the safety key is adapted to extend through an opening in the side surface of the tool tang. Embodiments of this nature are illustrated in FIGS. 3A-4C and 9A-10. In other embodiments, the safety key simply projects away from the tang T to a lesser extent in the retracted position than it does in the extended position (e.g., the safety key may not project laterally away from the tang at all when in the retracted position). This will typically be the case in American-style embodiments and other embodiments wherein the safety key is adapted to project from the top of the tool tang. Embodiments of this nature are illustrated FIGS. 2-2L and 8A-8B.

The manner in which the safety key engages the tool holder varies with different embodiments. For example, in Wila-style embodiments, the safety key typically extends through an opening in the side surface of the tool tang T and engages a safety slot (or "safety groove" or "safety recess") in the tool holder. Typically, the safety slot S/S is defined by a vertical wall W of the tool holder TH and extends along that wall longitudinally (i.e., along the axis indicated by arrow LO). In more detail, the safety slot S/S typically opens into a downwardly-open recess 8 defined by the tool holder, as shown in FIG. 1C. This recess 8 typically extends horizontally to define a longitudinally-extending channel in which the tang T of the tool TL is mounted during use.

Figure 1A:
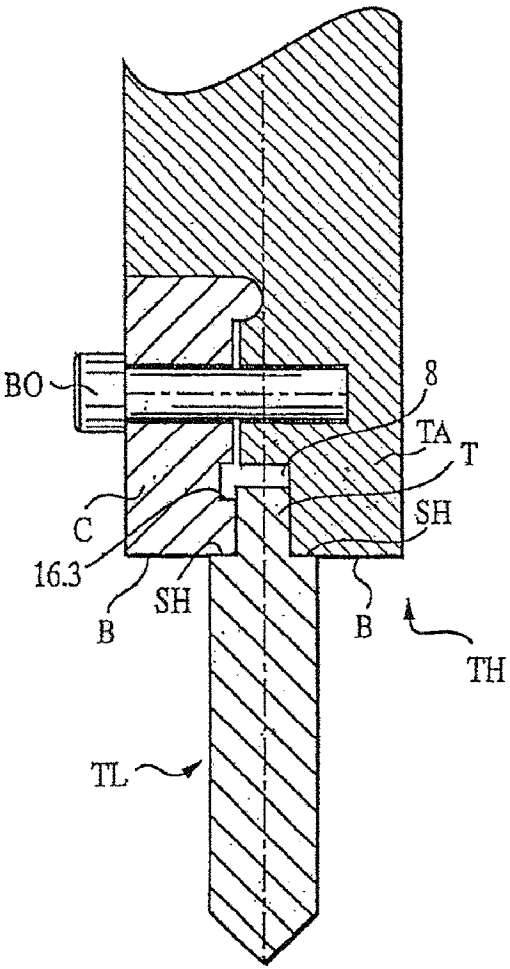
FIG. 1A is a schematic side view, partially broken away, of a press brake tool and tool holder of the American style.

In American-style embodiments, the safety key typically projects from the top of the tool tang and engages a shelf (e.g., bounding a safety groove) defined by the tool holder. Typically, the shelf 16.3 is within (e.g., open to) a downwardly-open recess 8 defined by the tool holder TH, as can be seen in FIG. 1A. In FIG. 1A, the shelf 16.3 is formed by an upwardly-facing shoulder (of the tool holder) having an upwardly-facing surface that is spaced upwardly from a downwardly-facing, force-delivering shoulder of the tool holder. This force-delivering shoulder is typically adjacent the bottom of the tool-receiving recess 8, which typically extends horizontally to define a longitudinally-extending channel in which the tang T of the tool TL is mounted during use.

As noted above, the safety key 50 preferably is lockable. In particular, the safety key preferably can be locked in its extended position. Thus, the tool preferably includes a lock that is operatively coupled to the safety key and is movable between a locked position and an unlocked position. Preferably, the lock is movable vertically (i.e., along the axis indicated by arrow V, as is perhaps best appreciated with reference to FIG. 2I) between its locked and unlocked positions. When the lock is in its locked position, the safety key is locked in its extended position (i.e., is prevented from moving into its retracted position). Preferably, the safety key has no freedom to move laterally, at least not laterally toward its retracted position, when the lock is in its locked position. For example, the lock preferably comprises a rigid body that, when in the locked position, applies direct force to (and thus positively locks) the safety key to keep it in its extended position. Thus, when the tool is operatively mounted in the tool holder with the safety key locked in the extended position, the lock assures the safety key is kept in full engagement with the tool holder at all times during operation.

The lock preferably comprises a transfer member that lockingly engages the safety key when in the locked position. The transfer member can be a body of various configurations. For example, the transfer member can be a transfer pin or plug 30, for example as shown in FIGS. 2-2L, 3A-4C, and 6A-10. Various other types of bodies can also be used as the transfer member. Preferably, the transfer member is a rigid (i.e., non-resilient) body. For example, the transfer member can be a solid (e.g., metal) body or a body having a rigid shell/housing.

In embodiments wherein the lock comprises a transfer pin, the pin can be provided in various configurations. For example, the transfer pin 30 can have a leading end 38 that is radiused (e.g., having a dome-like configuration), as shown in FIGS. 2-2A, 2F-2L, and 8A-8B. This is advantageous in that it can obviate the need to restrain the pin 30 against rotation about its axis. Other embodiments having this advantage include those shown in FIGS. 2D and 10, wherein the leading end 38 of the transfer pin 30 is tapered. In FIG. 2D, the leading end 38 of the transfer pin 30 has a conical configuration. In FIG. 10 the leading end 38 of the transfer pin 30 has a tapered peripheral surface 39 bounding a planar top surface. In certain embodiments, the leading end 38 of the transfer pin 30 is generally planar, as shown in FIGS. 2B, 3A-4C, and 9A-10, or tapered at a straight angle, as shown in FIGS. 2C and 2E. The term "leading end" is used to refer to the end of the transfer member (whether it is a pin, plug, etc.) that engages the safety key when the safety key is locked in its extended position.

In certain preferred embodiments, the lock comprises a transfer pin 30 that is adapted to lockingly engage the safety key when a leading end 38 of the transfer pin 30 cams with a cam portion 53 of the safety key 50. Embodiments of this nature include those exemplified in FIGS. 2-2L and 8A-8B. In these embodiments, the leading end 38 of the transfer pin 30 is vertically aligned with the cam portion 53 of the safety key 50 when the safety key is in its retracted position. When the transfer pin 30 is forced against the retracted safety key 50, the leading end 38 of the transfer pin bears against (and cams with) the cam portion 53 of the safety key and thereby produces motion of the safety key toward its extended position.

Thus, the leading end 38 of the transfer pin 30 and the cam portion 53 of the safety key 50 are configured such that when the transfer pin is forced against the safety key, the force transmitted from the transfer pin to the safety key has a component directed toward the safety key's extended position (i.e., laterally away from the tool tang). The leading end 38 of the transfer pin 30 and the cam portion 53 of the safety key 50 define cam surfaces 39, 52 and/or cam corners 37, 37' that can be provided in various configurations to facilitate the desired camming engagement.

Figure 2:
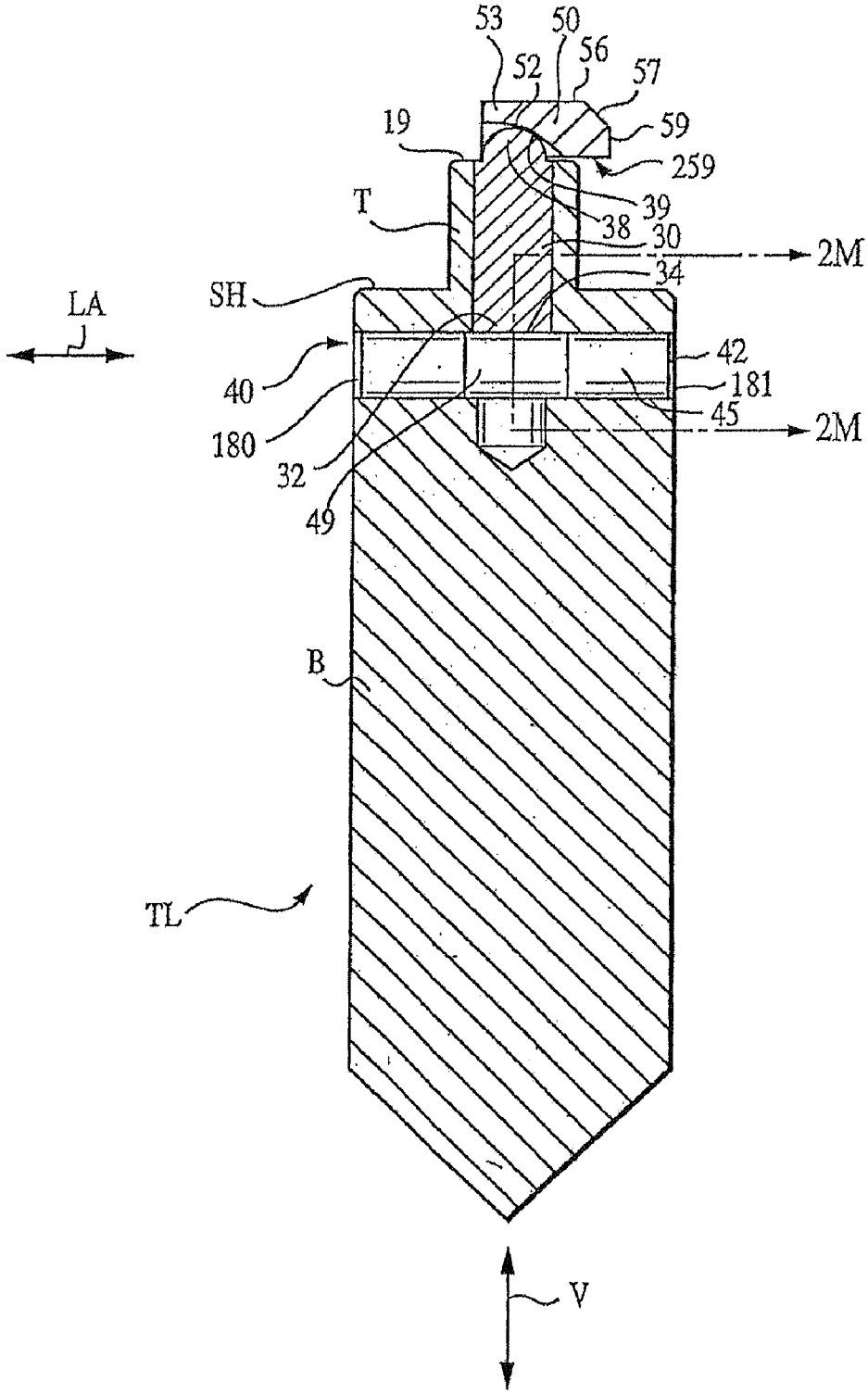
FIG. 2 is a schematic side view of a press brake tool in accordance with certain embodiments of the present invention.
Figure 2A:
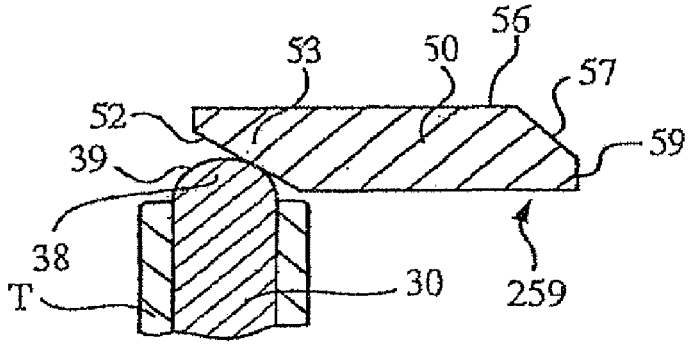
FIG. 2A is a side detail view, partially broken away, of a press brake tool in accordance with certain embodiments of the invention.
Figure 2B:
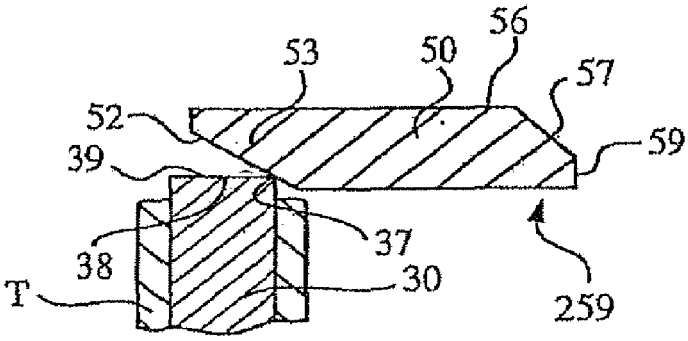
FIG. 2B is a side detail view, partially broken away, of a press brake tool in accordance with certain embodiments of the invention.
Figure 2C:
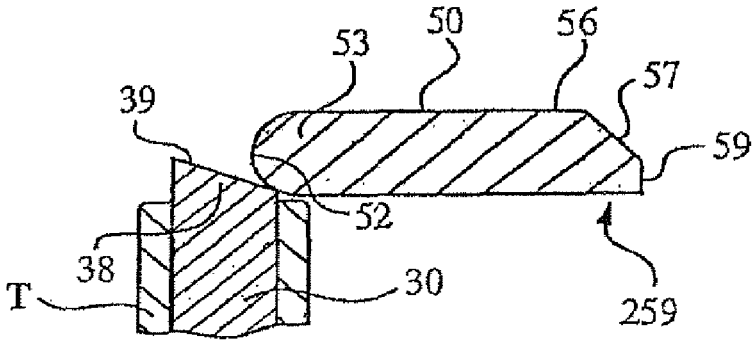
FIG. 2C is a side detail view, partially broken away, of a press brake tool in accordance with certain embodiments of the invention.
Figure 2D:
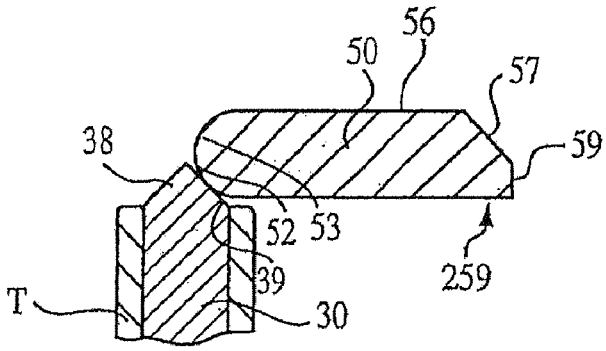
FIG. 2D is a side detail view, partially broken away, of a press brake tool in accordance with certain embodiments of the invention.
Figure 2E:
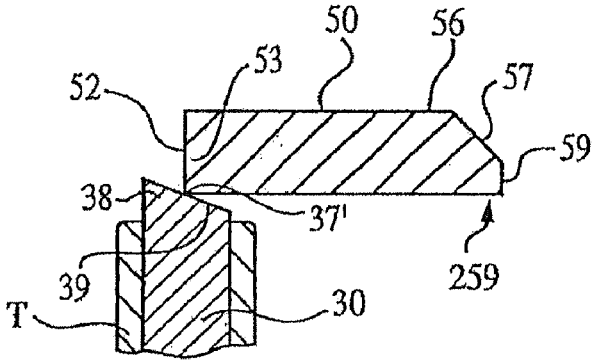
FIG. 2E is a side detail view, partially broken away, of a press brake tool in accordance with certain embodiments of the invention.
Figure 2F:
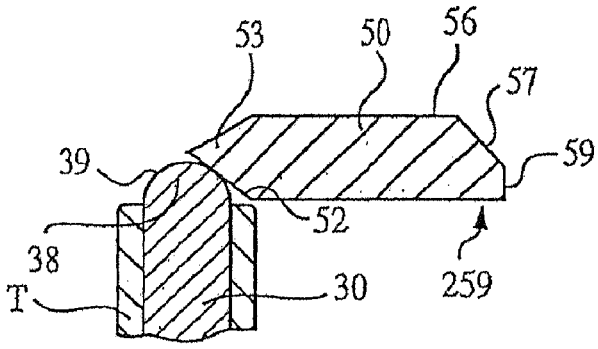
FIG. 2F is a side detail view, partially broken away, of a press brake tool in accordance with certain embodiments of the invention.
Figure 2G:
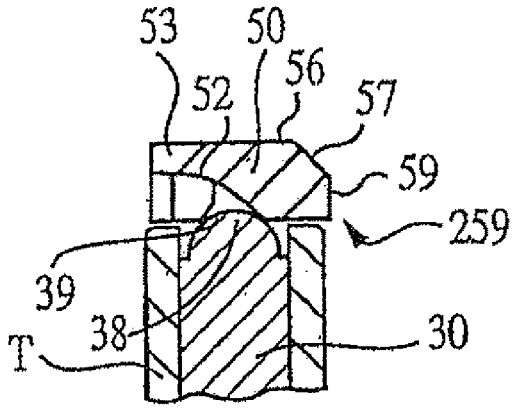
FIG. 2G is a side detail view, partially broken away, of a press brake tool in accordance with certain embodiments of the invention.

FIG. 2 depicts an embodiment wherein the safety key 50 has a tapered cam portion 53 and the transfer pin 30 has a radiused leading end 38. Here, the cam portion 53 of the safety key 50 defines a cam surface 52 that is curved. This cam surface 52 can alternatively be provided at a straight angle, as shown in FIGS. 2A-2B. As another alternative, the cam portion 53 of the safety key 50 can be radiused, as shown in FIGS. 2C-2D. As still another alternative, the cam portion 53 of the safety key 50 can be generally planar (e.g., having a cam corner 37' against which the leading end 38 of the transfer pin 30 is adapted to bear), as shown in FIG. 2E. In a further alternative, the cam portion 53 of the safety key 50 has a generally-conical configuration, as shown in FIG. 2F.

The leading end 38 of the transfer pin 30 can also be provided in various configurations to facilitate the desired camming engagement. For example, the leading end 38 of the transfer pin 30 can be radiused, as shown in FIGS. 2-2A and 2F-2L. Alternatively, the leading end 38 of the transfer pin 30 can have a generally-conical configuration, as shown in FIG. 2D. As another alternative, the leading end 38 of the transfer pin 30 can be tapered to define a straight-angle cam surface, as shown in FIGS. 2C and 2E. As still another alternative, the leading end 38 of the transfer pin 30 can be generally planar (e.g., having a corner 37 that is adapted to bear against the cam surface 52 of the safety key 50), as shown in FIG. 2B. In embodiments wherein one of the leading end 38 of the transfer pin 30 and the cam portion 53 of the safety key 50 is generally planar, the other preferably is tapered to facilitate the desired camming engagement. Thus, in the present cam locking embodiments, it is preferable if at least one of the leading end 38 of the transfer pin 30 and the cam portion 53 of the safety key 50 is tapered. Further, both the leading end 38 of the transfer pin 30 and the cam portion 53 of the safety key 50 can be tapered, as shown in FIGS. 2-2A, 2C-2D, and 2F-2I.

Figure 2H:
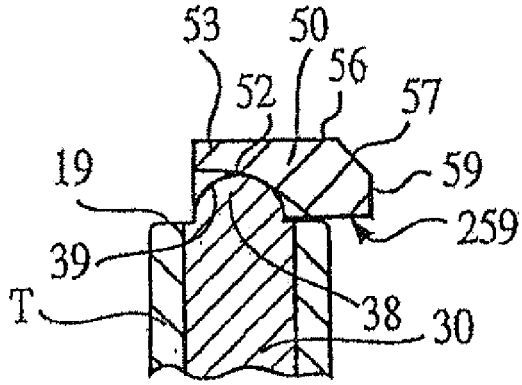
FIG. 2H is a side detail view, partially broken away, of a press brake tool in accordance with certain embodiments of the invention.

With reference to FIG. 2, the illustrated safety key 50 (which is described below in further detail) is joined to (e.g., mounted on) the tool tang in such a way that the safety key is free (when the lock is in its unlocked position) to move laterally between its retracted position (shown in FIG. 2G) and its extended position (shown in FIG. 2H). This can be accomplished in various ways.

Figure 2I:
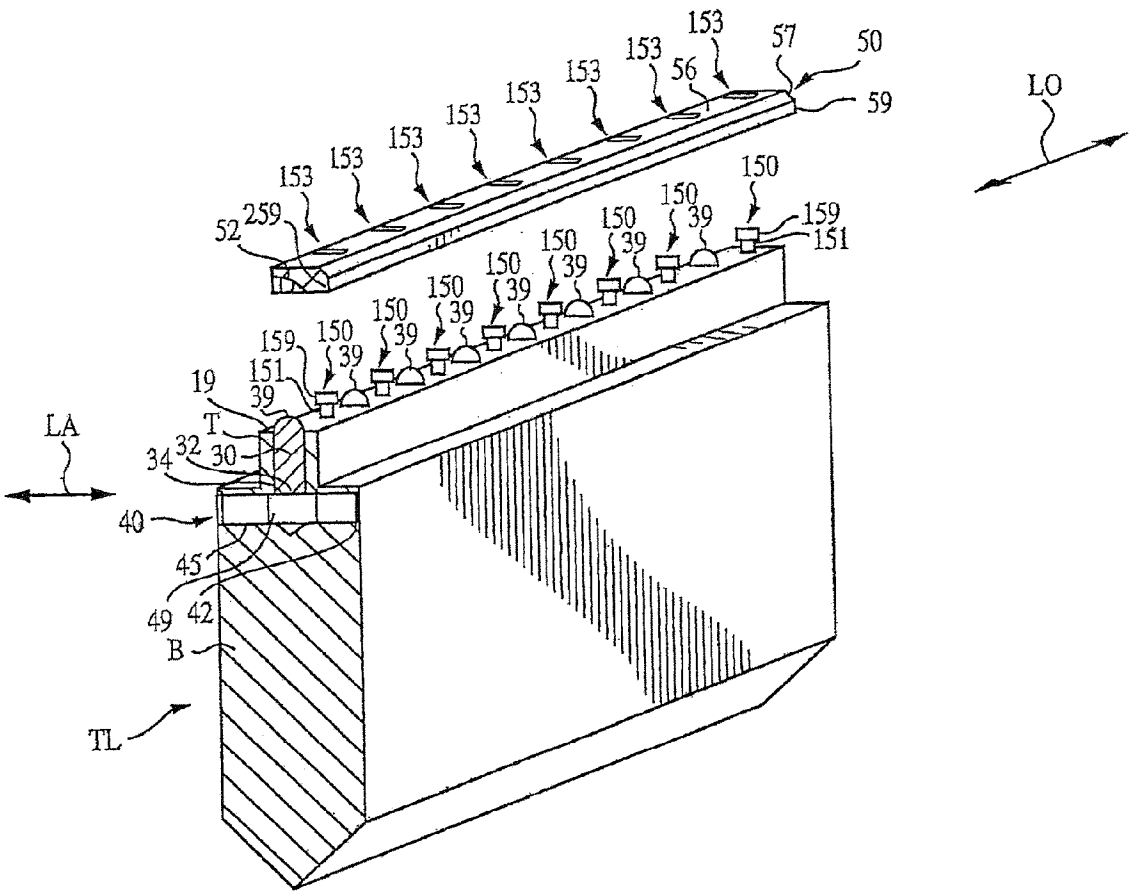
FIG. 2I is a perspective view, partially exploded, of a press brake tool in accordance with certain embodiments of the invention.

As depicted in FIG. 2I, a plurality of shoulder bolts 150 extending from the tool tang T can be provided to hold down the safety key 50 but allow it to move laterally between its extended and retracted positions. Here, each shoulder bolt 150 is anchored in the tool tang T and has a narrow portion 151 (or "neck") that extends outwardly from the tool tang to an enlarged portion 159 (or "head"). The illustrated safety key 50 includes a plurality of bores 153 each having a narrow region (e.g., a small-diameter region) and a wide region (e.g., a large-diameter region). The necks 151 of the shoulder bolts 150 extend away from the tool tang and through the narrow regions of respective bores 153, while the heads 159 of the bolts 150 are received in the wide regions of the respective bores 153. Alternatively, the wide regions of the bores can be omitted and the heads of the bolts can simply ride on the top surface 56 of the safety key. The heads 159 of the shoulder bolts 150 have a larger dimension (e.g., diameter) than the narrow regions of the respective bores 153. As a result, the safety key 50 is prevented from moving vertically (or at least is prevented from moving substantially in a vertical direction). The bores 150 are elongated in the lateral direction (so as to form laterally-elongated slots), such that the safety key 50 is free to move laterally between its extended and retracted positions. Thus, the safety key 50 when joined to the tool tang T has freedom of lateral motion (when the lock is in its unlocked position) to an extent that allows the safety key to move between its extended and retracted positions, but preferably has substantially no freedom of vertical or longitudinal motion.

In the embodiment of FIG. 2, the transfer pin 30 is received in a vertical bore, for example bore 80 shown in FIGS. 3C-4C, that opens through a top surface 19 of the tool tang T and extends downwardly (i.e., toward the tool's tip) through the tool tang and into the tool body B. Preferably, the transfer pin 30 is mounted slidingly in this bore 80, such that the pin can be moved axially therein. When the transfer pin 30 is moved axially in the upward direction (i.e., away from the tool's tip), the leading end 38 of the transfer pin bears against the cam portion 53 of the safety key 50 and thereby produces lateral motion of the safety key toward its extended position.

Figure 2J:
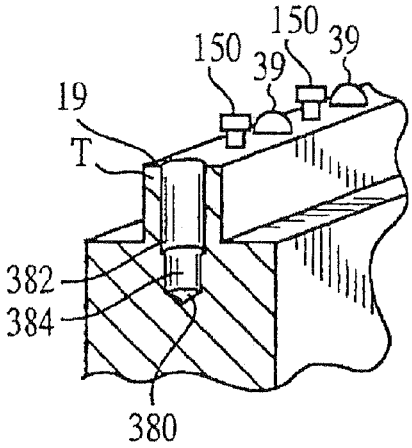
FIG. 2J is a perspective detail view, partially broken away, of a press brake tool in accordance with certain embodiments of the invention.
Figure 2K:
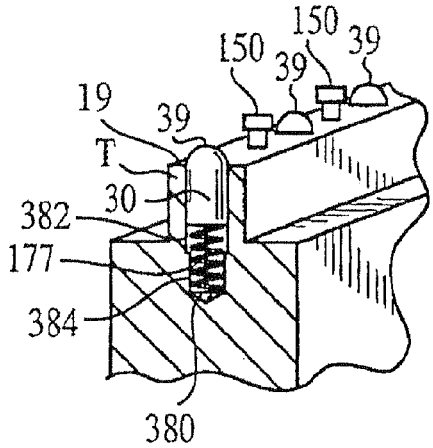
FIG. 2K is a perspective detail view, partially broken away, of a press brake tool in accordance with certain embodiments of the invention.
Figure 2L:
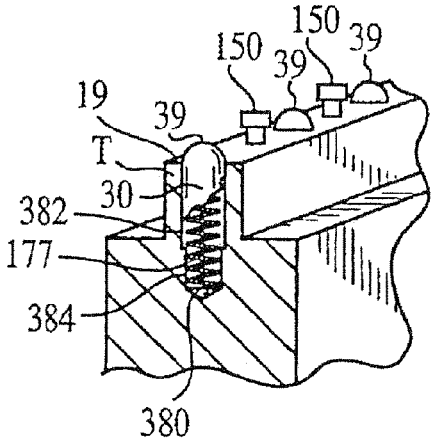
FIG. 2L is a perspective detail view, partially broken away, of a press brake tool in accordance with certain embodiments of the invention.
Figure 2M:
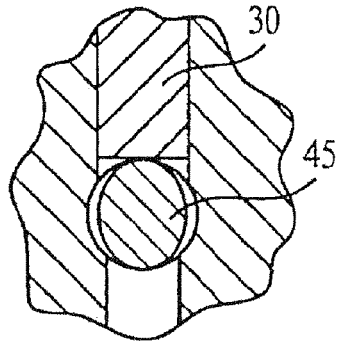
FIG. 2M is a cross sectional side view, taken along lines 2M, of the press brake tool of FIG. 2.

In the embodiments of FIGS. 2-2L, the safety key 50 is adapted to project from the top of the tool tang T, as is characteristic of American-style tooling. However, a cam locking mechanism of the described nature can be provided in any desired tooling style. For example, a cam locking mechanism of this nature can be employed in embodiments wherein the safety key extends through an opening in the side surface of the tool tang T (e.g., in Wila-style embodiments).

In certain preferred embodiments, the lock comprises a transfer pin 30 that is adapted to lockingly engage the safety key 50 when a detent of the transfer pin engages a detent of the safety key. Embodiments of this nature are exemplified in FIGS. 3A-4C and 9A-10. In these embodiments, the detent of the safety key preferably is female and the detent of the transfer pin preferably is male. However, embodiments can also be provided wherein the reverse situation is employed.

In FIGS. 3A-4C and 9A-10, the side of the safety key 50 defines a female detent 51 and the leading end 38 of the transfer pin 30 acts as a male detent. The leading end 38 of the transfer pin 30, when in the locked position, extends into the female detent 51 and bears against a shoulder 55 of the safety key 50 to provide a locking engagement between the transfer pin and the safety key. The female detent 51 of the safety key 50 is vertically aligned with the leading end 38 of the transfer pin 30 when the safety key is in its extended position. Thus, by moving the transfer pin 30 upwardly when the safety key 50 is in its extended position, the leading end 38 of the transfer pin and the female detent 51 of the safety key can be engaged. This engagement positively locks the safety key 50 in its extended position.

Figure 9A:
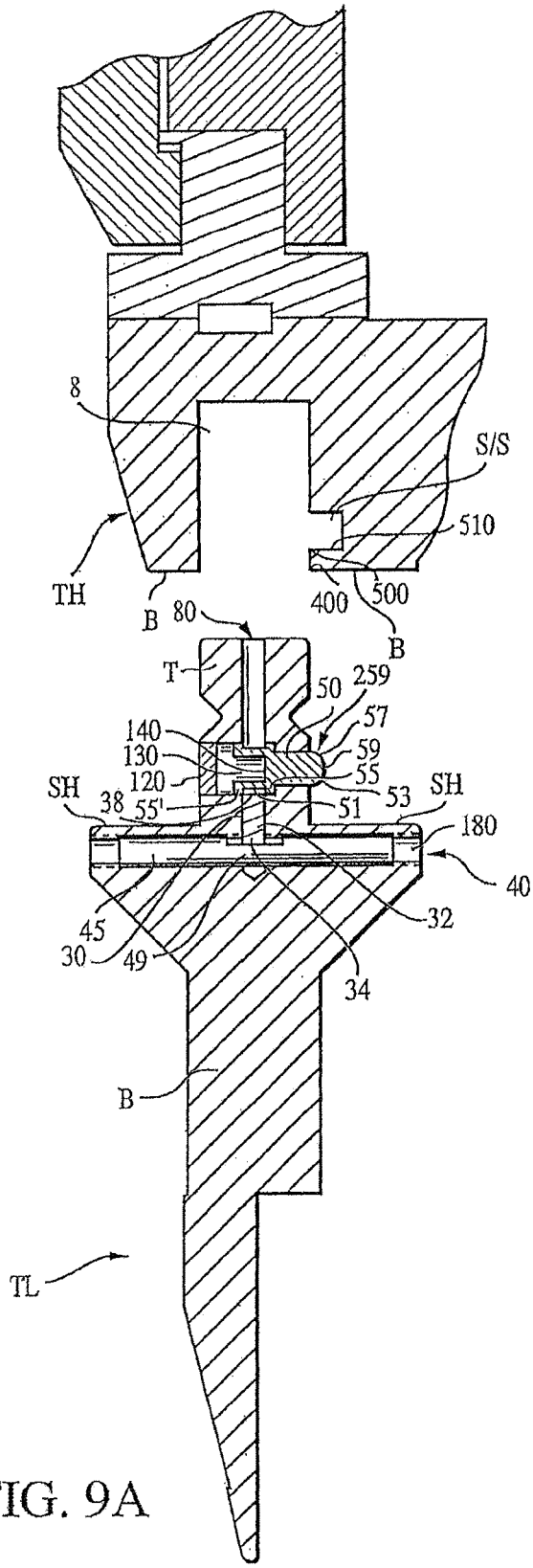
FIG. 9A is a schematic side view, partially broken away, of a press brake tool and tool holder, prior to mounting the tool in the tool holder, in accordance with certain embodiments of the invention.
Figure 9B:
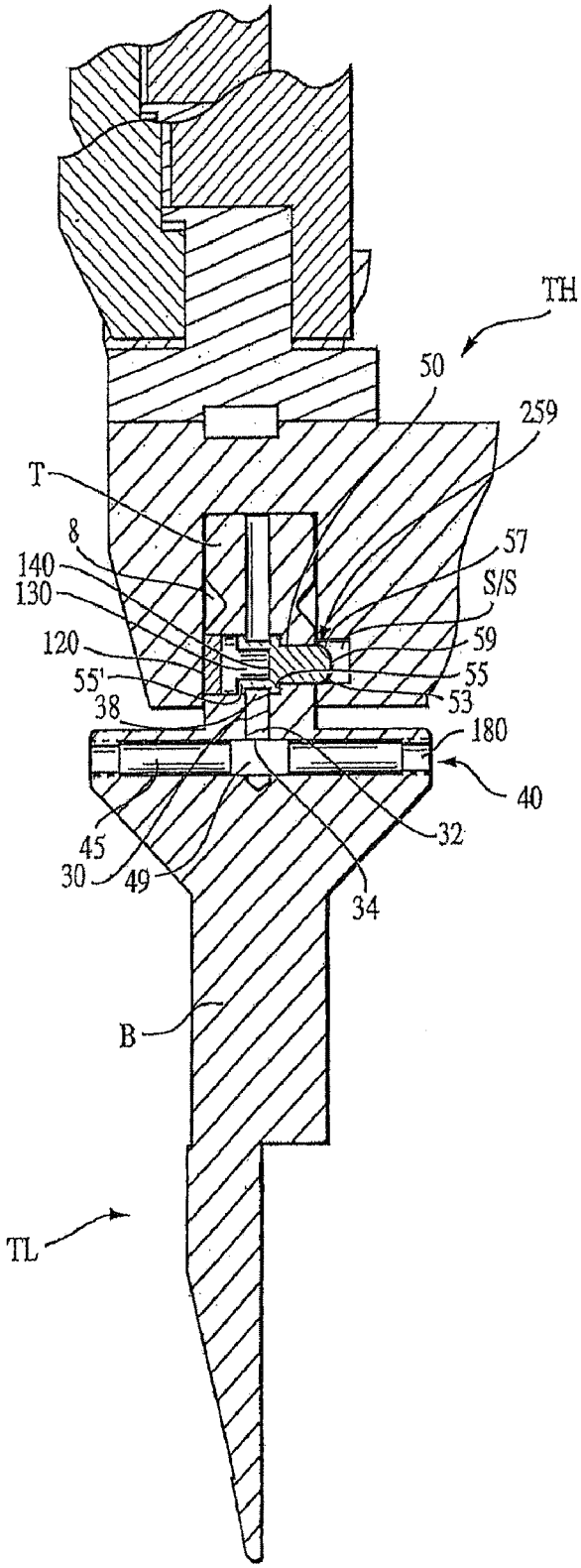
FIG. 9B is a schematic side view, partially broken away, of the press brake tool and tool holder of FIG. 9A wherein the tool is operatively mounted in the tool holder.
Figure 10:
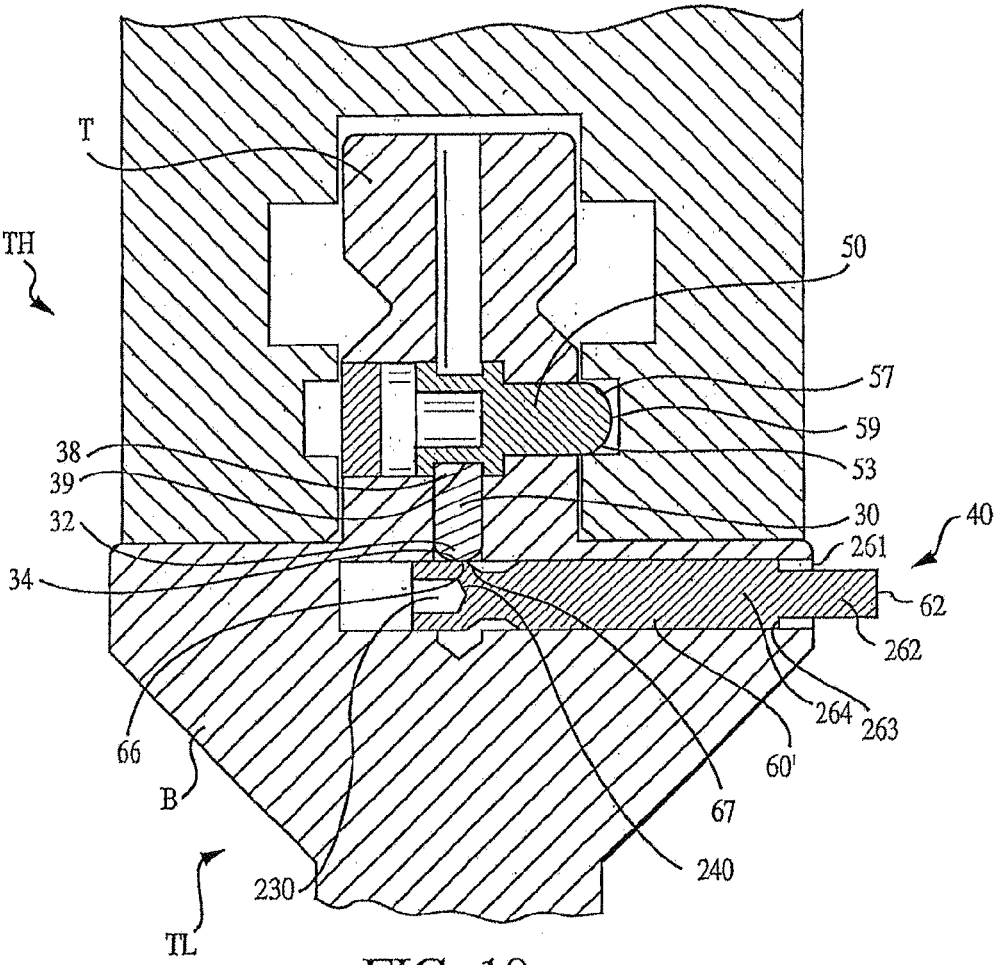
FIG. 10 is a broken-away, cross-sectional side view of a press brake tool and tool holder wherein the tool is operatively mounted in the tool holder in accordance with certain embodiments of the invention.

Thus, in the embodiments of FIGS. 3A-4C and 9A-10, when the transfer pin 30 is moved into the locked position, the leading end 38 of the transfer pin engages (e.g., fits into) the female detent 51 on the safety key 50, thereby preventing the safety key from moving laterally into its retracted position. FIGS. 3A, 4B, 9B, and 10 depict the safety key 50 locked in its extended position, FIG. 3B depicts the safety key unlocked in its retracted position, and FIG. 9A depicts the safety key 50 unlocked in its extended position.

In the embodiments of FIGS. 3A-4C and 9A-10, the shoulders 55, 55' bounding the female detent 51 on the safety key 50 can be somewhat tapered, if so desired. This can facilitate unlocking the safety key 50. For example, the shoulders 55, 55' can be tapered such that moving the safety key 50 toward its retracted position will force the transfer pin 30 downwardly toward the unlocked position even if gravity does not automatically move the transfer pin 30 downwardly into the unlocked position. Tapering the shoulders 55, 55' can also facilitate locking the safety key 50. For example, this can ensure proper locking engagement of the transfer pin 30 and the female detent 51, even if a weakened spring does not move the safety key far enough toward its extended position to bring the female detent 51 into full vertical alignment with the leading end 38 of the transfer pin. The same effects can be achieved by somewhat tapering the leading end 38 of the transfer pin 30, for example as shown in FIGS. 2 and 2A.

Figure 3A:
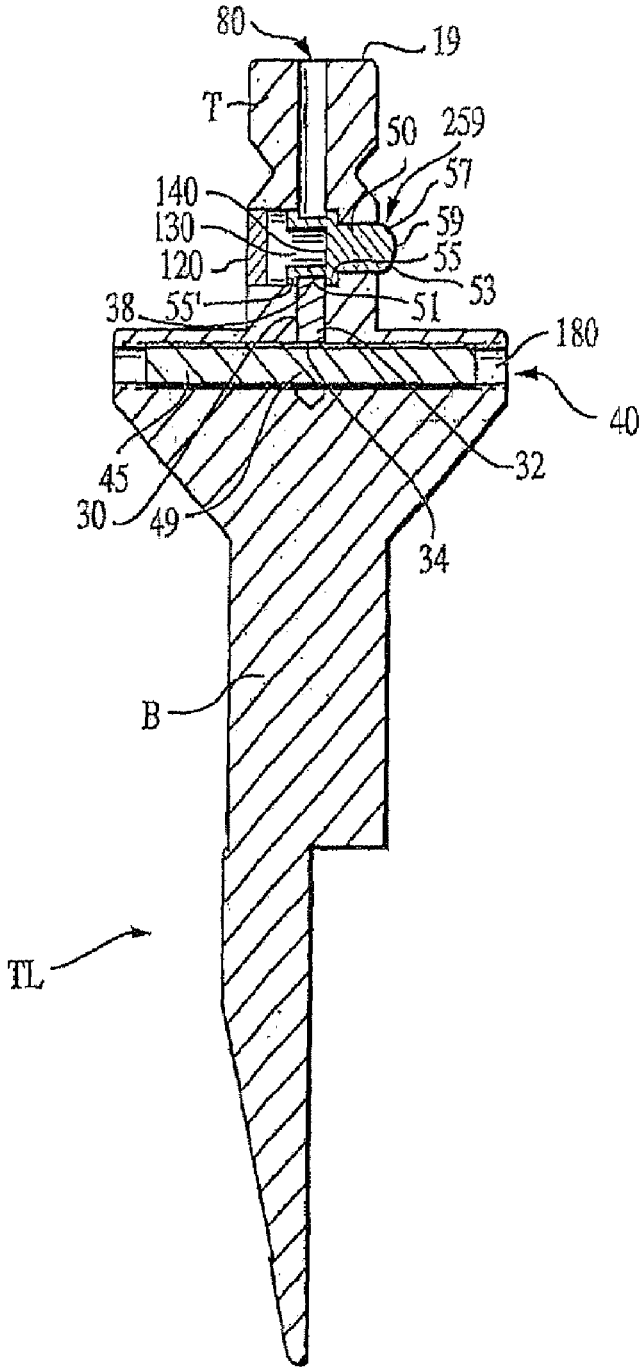
FIG. 3A is a schematic side view of a press brake tool having a safety key locked in an extended position in accordance with certain embodiments of the invention.
Figure 3B:
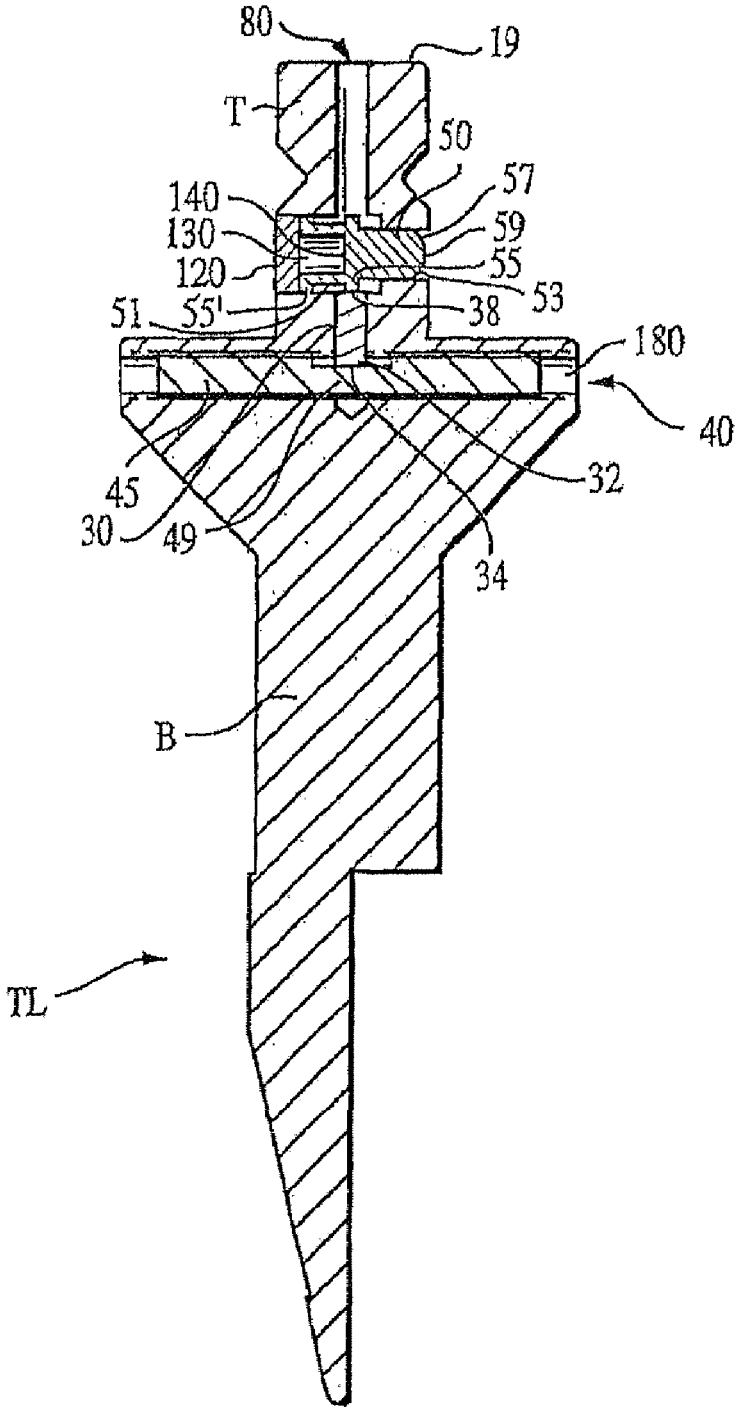
FIG. 3B is a schematic side view of the press brake tool of FIG. 3A wherein the safety key is in a retracted unlocked position.
Figure 3C:
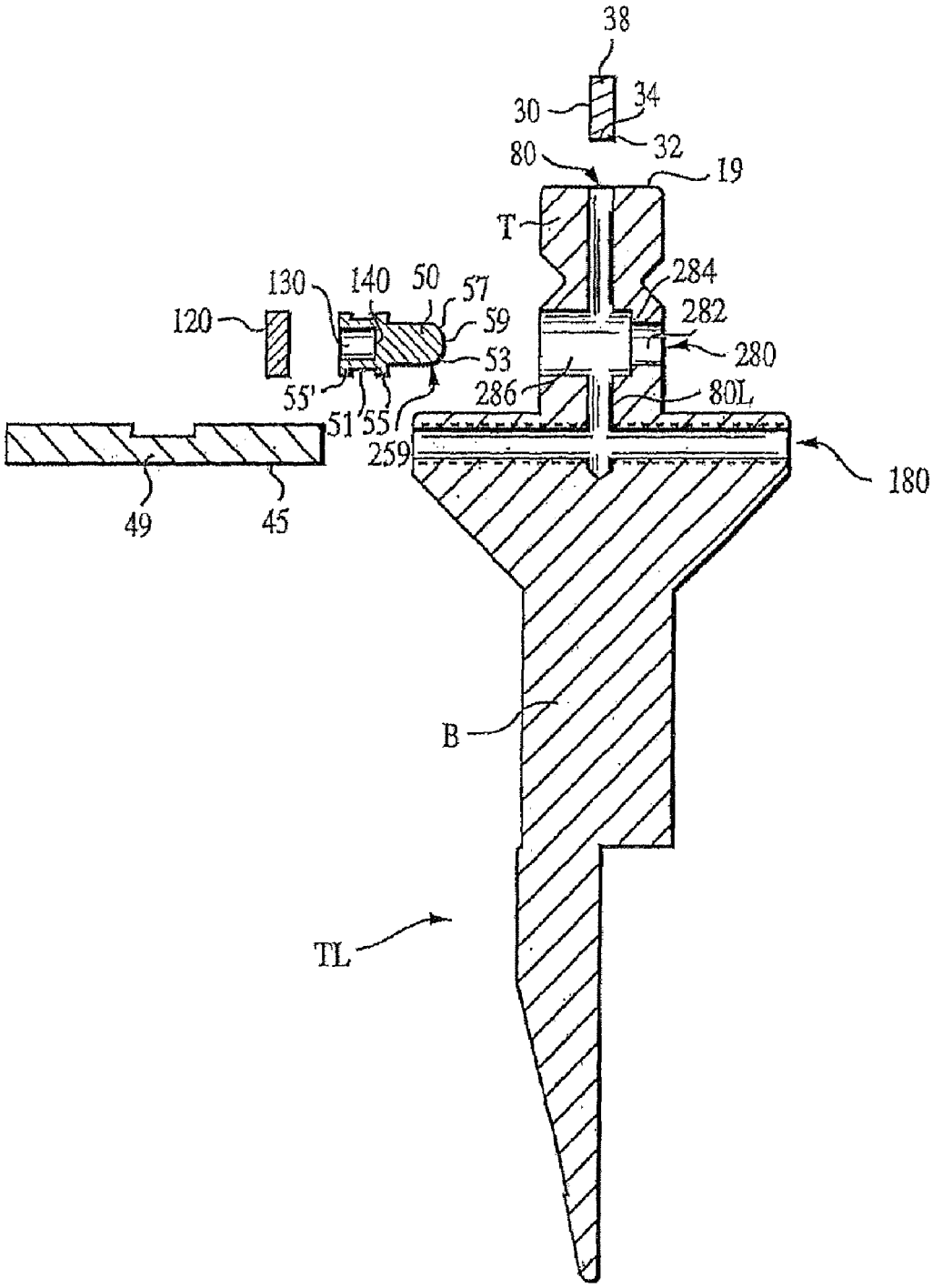
FIG. 3C is an exploded side view of the press brake tool of FIG. 3A.
Figure 4A:
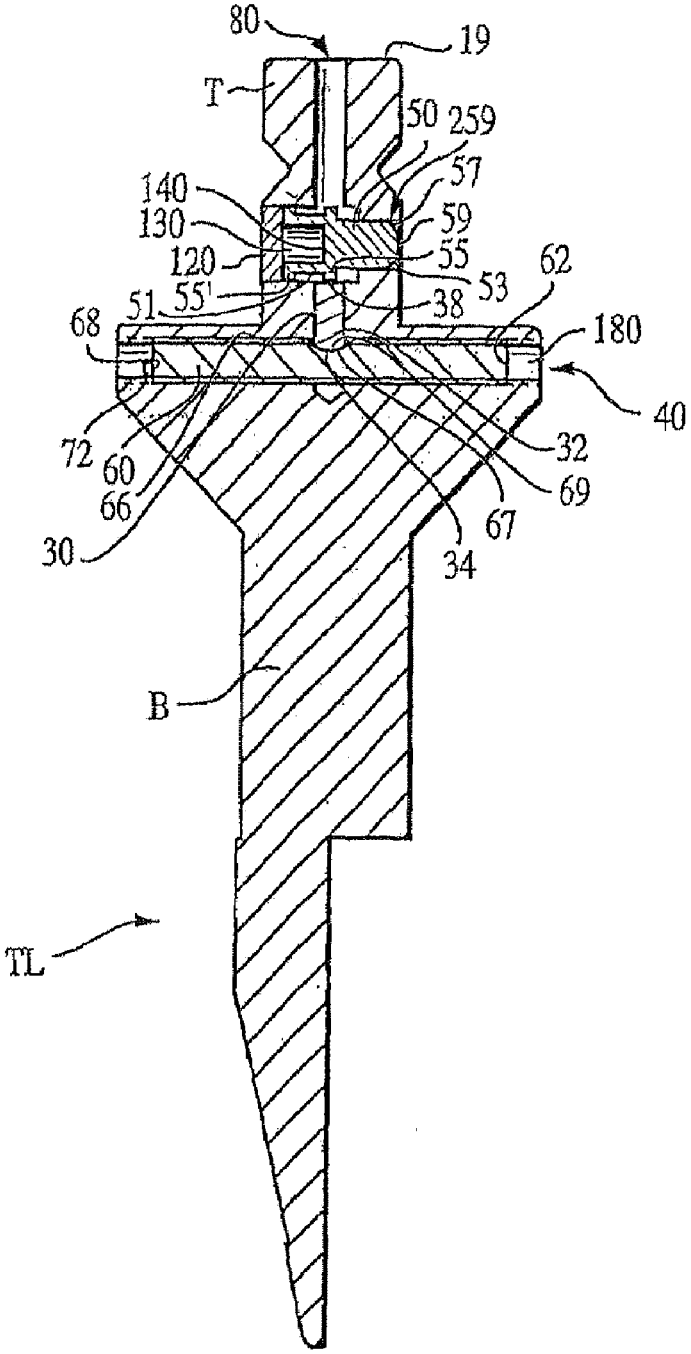
FIG. 4A is a schematic side view of a press brake tool having a safety key in a retracted unlocked position in accordance with certain embodiments of the invention.
Figure 4B:
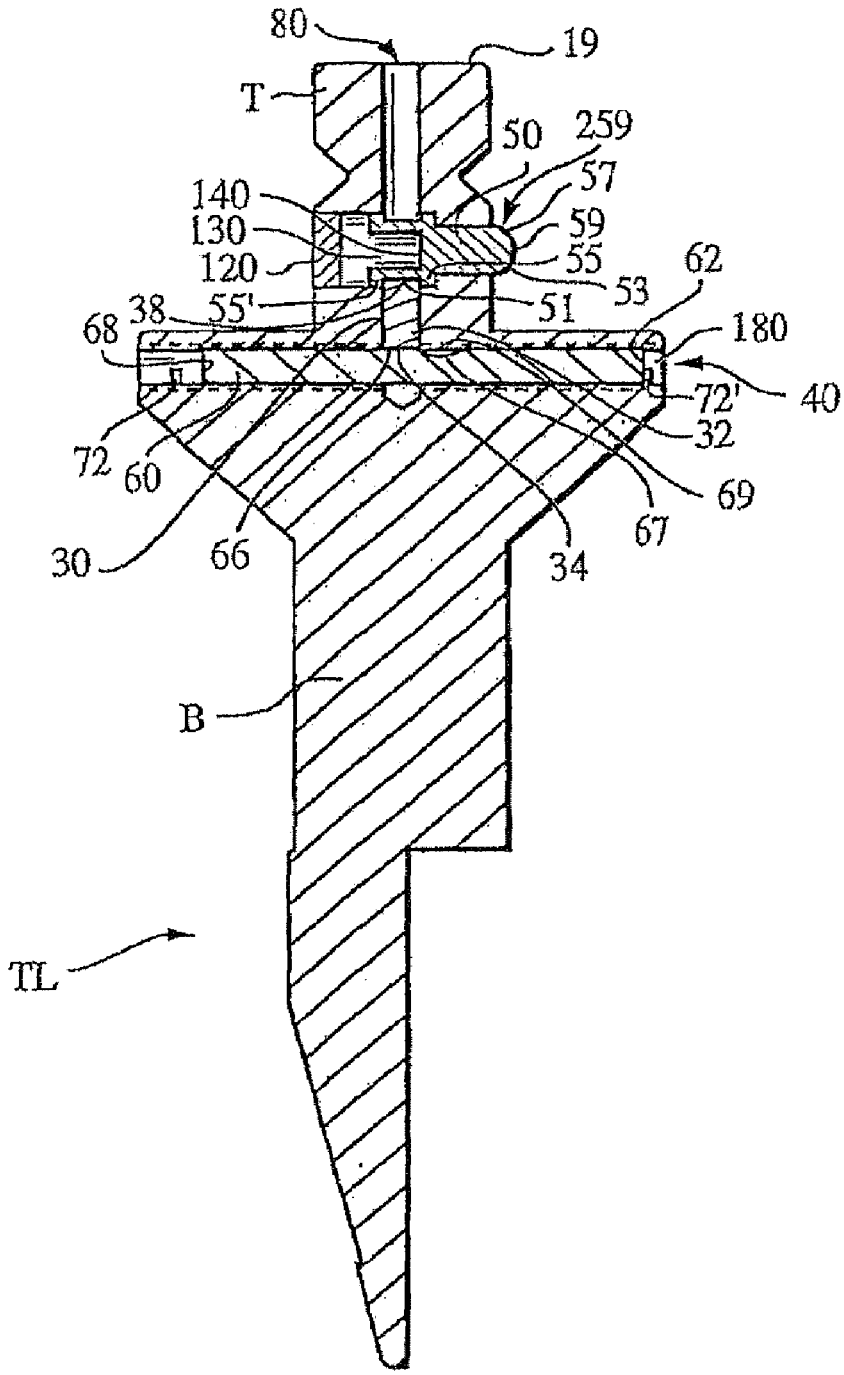
FIG. 4B is a schematic side view of the press brake tool of FIG. 4A wherein the safety key is locked in an extended position.
Figure 4C:
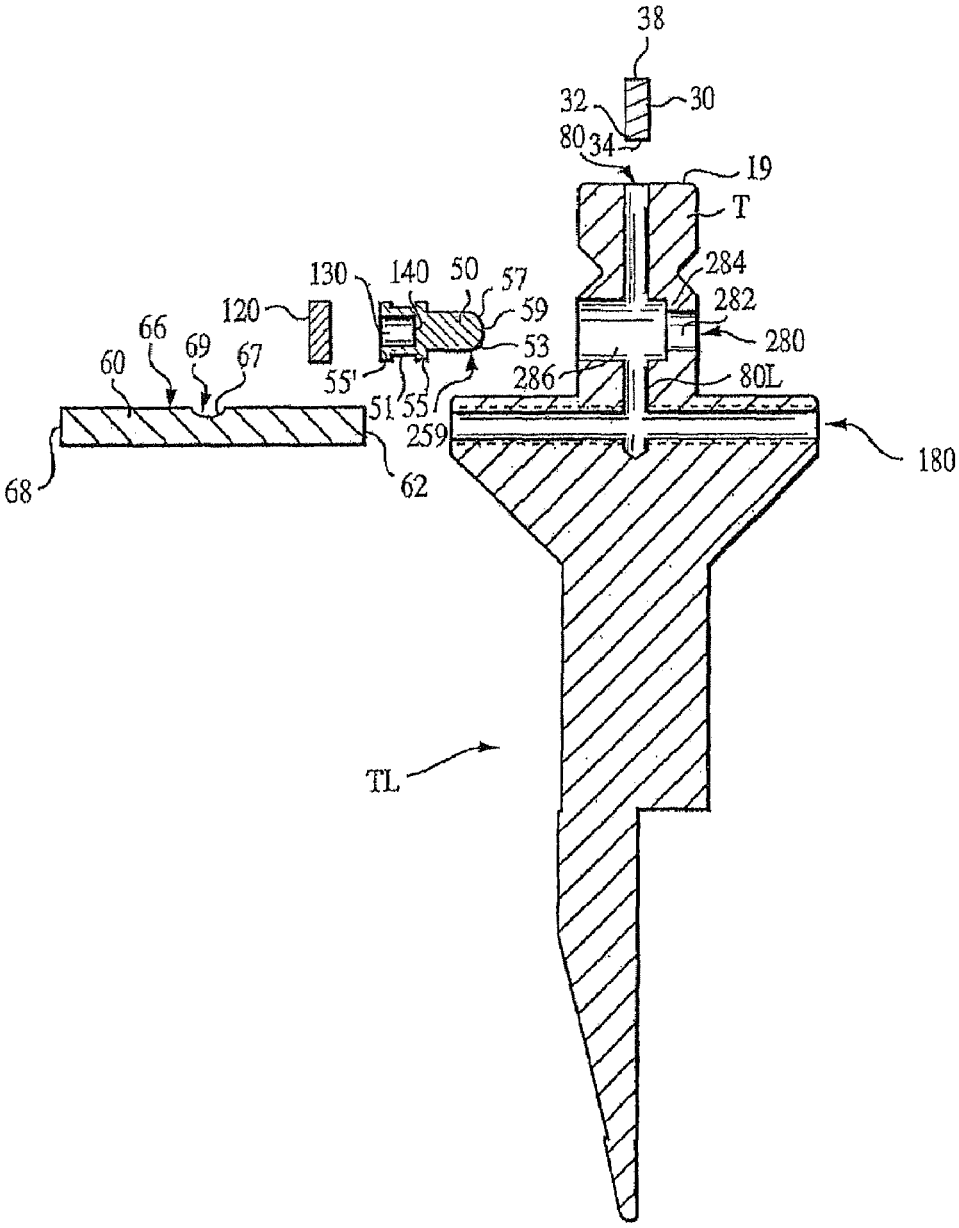
FIG. 4C is an exploded side view of the press brake tool of FIG. 4A.

With reference to FIGS. 3C and 4C it can be appreciated that the illustrated transfer pin 30 is received in a vertical bore 80 that opens through an end surface 19 of the tool tang T and extends vertically through the tang T and into the body B of the tool TL. Here, the transfer pin 30 is received in a section 80L of the bore 80. Preferably, the transfer pin 30 is mounted slidingly in this bore, such that the pin can be moved axially therein. Thus, the transfer pin 30 can be moved axially while the safety key 50 is in its extended position, until the leading end 38 of the transfer pin engages the female detent 51 on the safety key, thereby locking the safety key in its extended position.

The safety key 50 in FIGS. 3A-4C and 9A-10 extends through an opening in the side surface of the tool tang T, as is characteristic of Wila-style tooling. However, a detent locking mechanism of the described nature (wherein a detent on the transfer member is adapted to engage a detent on the safety key) can be provided in any desired tooling style. For example, a detent locking mechanism of this nature can be employed in embodiments wherein the safety key is adapted to project from the top of the tool tang (e.g., in American-style embodiments). In the embodiments of FIGS. 3A-4C and 9A-10, the safety key 50 can be a lock pin, if so desired.

Thus, the invention provides various embodiments comprising an externally-operable lock assembly that is moveable between locked and unlocked positions, wherein the lock assembly includes a surface (which in some cases is defined by a leading end of a transfer member) that, when the assembly is in the locked position, engages and prevents movement of the safety key toward the unlocked position. Numerous exemplary embodiments of this nature are described herein.

In certain preferred embodiments of the invention, the press brake tool includes an actuator that is operatively coupled to the lock. In these embodiments, the actuator can be operated to move the lock between its locked position and its unlocked position. In embodiments wherein the lock comprises a transfer member, the actuator preferably is coupled to the transfer member such that the actuator can be operated to move the transfer member between the locked and unlocked positions. The actuator can be provided in various forms.

In certain particularly preferred embodiments, the actuator 40 comprises a lobe pin 45. Typically, the lobe pin 45 includes a cam portion 49 having at least two different diameters. The lobe pin 45 typically is rotatable between a small-diameter orientation (e.g., wherein a small diameter of the cam portion 49 is vertically oriented) and a large-diameter orientation (e.g., wherein a large diameter of the cam portion 49 is vertically oriented). This is perhaps best appreciated with reference to Figures and 2M and 3C. The lobe pin 45 can be received in a horizontal bore 180 formed in the tool, such that the lobe pin is rotatable therein (at least between its small-diameter orientation and its large-diameter orientation). The cam portion 49 of the lobe pin 45 preferably abuts the lock, such that when the lobe pin is rotated into its large-diameter orientation, the cam portion of the lobe pin bears against (and cams with) the lock and thereby moves the lock into its locked position.

Embodiments of this nature are shown in FIGS. 2, 2I, 2M, 3A-3C, and 8A-9B, wherein the lobe pin 45 is received in a lateral bore 180 formed in the tool TL. This lateral bore 180 intersects (i.e., opens into) the vertical bore 80 in which the transfer member 30, 30' is received. The lobe pin 45 and the transfer member 30, 30', when operatively mounted in their respective bores 180, 80, are configured such that the cam portion 49 of the lobe pin abuts an end 32 of the transfer member. Thus, when the lobe pin 45 is rotated into its large-diameter orientation (depicted in FIGS. 2, 2I, 2M, 3A, 8B, and 9B), the cam portion 49 of the lobe pin bears against (and cams with) an end 32 of the transfer member 30, 30', such that the transfer member is forced toward the locked position. On the other hand, when the lobe pin 45 is rotated into its small-diameter orientation (depicted in FIGS. 3B, 8A, and 9A), the transfer member 30, 30' is free to move toward the unlocked position.

The lobe pin 45 can be threadingly received in the bore 180, if so desired. For example, the lobe pin 45 can be exteriorly threaded and the bore 180 can be interiorly threaded. Alternatively, the lobe pin 45 can be slidingly received in the bore 180, such that the pin 45 is free to be rotated about its axis. If so desired, stops can be provided such that rotation of the pin in one direction until reaching a stop brings the pin to its large-diameter orientation, while rotation of the pin in the other direction until reaching a stop brings the pin to its small-diameter orientation.

Typically, at least one end 42 of the lobe pin 45 is accessible to an operator when the pin 45 is mounted operatively in the bore 180. The accessible end 42 of the lobe pin 45 is preferably exposed (such that it is externally accessible) via an opening 181 of the bore 180 through a front wall of the tool (i.e., a wall that faces an operator position) when the tool is mounted operatively on a tool holder. Thus, it is to be appreciated that certain embodiments provide an externally-operable lock assembly having at least one externally-accessible actuator. If so desired, both ends of the lobe pin 45 can be accessible (e.g., through respective openings in front and back walls of the tool). Preferably, the lobe pin 45 has at least one accessible end comprising a male projection (e.g., a flange or the like) or a female detent (e.g., a slot, Allen-wrench opening, or the like) that facilitates rotating the lobe pin between its small-diameter orientation and its large-diameter orientation.

In certain preferred embodiments, the actuator 40 comprises a dimple pin 60. Typically, the dimple pin 60 is movable between a first position and a second position, wherein the first position is characterized by alignment of the lock with a dimple 69 on the pin 60, while the second position is characterized by alignment of the lock with a large-diameter portion 66 (i.e., a flat 66) of the pin 60. For example, the dimple pin 60 can be received in a horizontal bore 180 formed in the tool, such that the dimple pin is movable axially and/or rotationally therein (at least between its first and second positions). A side portion of the dimple pin 60 preferably abuts the lock, such that when the dimple pin is moved into its second position, the angled dimple surface 67 of the pin 60 bears against (and cams with) the lock and thereby moves the lock into its locked position.

Embodiments of this nature are shown in FIGS. 4A-4C, wherein the dimple pin 60 is received in a lateral bore 180 formed in the tool TL. This lateral bore 180 intersects the vertical bore 80 in which the transfer pin 30 is received. The dimple pin 60 and the transfer pin 30, when operatively mounted in their respective bores 180, 80, are configured such that a side portion of the dimple pin abuts an end 32 of the transfer pin. Thus, when the dimple pin 60 is moved into its second position (depicted in FIG. 4B), the angled dimple surface 67 bears against (and cams with) an end 32 of the transfer pin 30, such that the transfer pin slides out of the dimple 69 and onto a large-diameter portion 66 of the dimple pin. When this occurs, the transfer pin 30 is forced toward the locked position. On the other hand, when the dimple pin 60 is moved into its first position (depicted in FIG. 4A), the transfer pin 30 is in aligned with the dimple 69 and thus is free to move toward the unlocked position.

Figure 5:
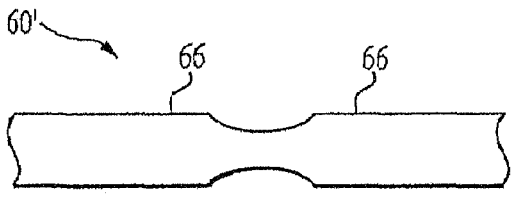
FIG. 5 is a broken-away side detail view of a pin having utility in certain embodiments of the invention.

In embodiments wherein the actuator comprises a dimple pin, it may be preferable if the dimple extends entirely around the circumference of the pin. A pin 60' of this nature is exemplified in FIGS. 5 and 10. With such a pin 60', it is not necessary to mount the pin 60' in the bore 180 in such a way that the pin 60' is prevented from rotating about its axis. Alternatively, the dimple pin can be provided with a simple dimple (i.e., one at a particular circumferential location on the pin, not extending about the entire circumference of the pin), and a key/keyway engagement can be provided between the pin 60' and the wall 180W of the bore 180. The dimple pin 60 can thus be maintained in a desired rotational orientation wherein the dimple 69 is oriented toward the transfer pin 30. As another alternative, the pin can have a simple dimple and can be threadingly received in the bore 180 in such a way that a certain amount of rotation of the pin in one direction brings the pin to its first position, while a certain amount of rotation of the pin in the other direction brings the pin to its second position.

The dimple pin 60 can be mounted for axial and/or rotational movement within the bore 80. In certain embodiments, the pin 60 is simply moved axially (without rotation about its axis) to move the dimple into and out of alignment with the transfer pin 30. In embodiments of this nature, the dimple pin 60 preferably is slidably received in the bore 180 (i.e., such that the pin 60 can be slidingly moved axially within the bore 180). In such embodiments, both ends 62, 68 of the dimple pin 60 typically are accessible to an operator. Thus, the operator can push one end of the dimple pin 60 to move the pin into its first position, and then when it is desired to move the pin into its second position, the operator can push the other end of the pin 60 to move it into the second position. It may be desirable to provide a stop 72 that is positioned in the bore such that when the pin 60 is moved axially into engagement with the stop 72, the dimple 69 on the pin 60 is aligned with the transfer pin 30 (as shown in FIG. 4A). If so desired, a second stop 72' can be provided such that when the pin 60 is moved into engagement with this stop 72', a large-diameter portion 66 of the pin is aligned with the transfer pin 30 (as shown in FIG. 4B).

In the embodiment of FIG. 10, the safety key 50 is adapted to extend through an opening in the side surface of the tool tang and the dimple pin 60' has one end 62 that extends outwardly (at least when the pin 60' is in a second position) through an opening in the tool body. The other end of the pin 60' is spring loaded such that the pin 60' is biased toward its second position (wherein the lock is in its locked position). Thus, the dimple pin is normally held in its second position unless the pin 60' is forced (against the force of the spring) into its first position (wherein the lock is in its unlocked position). Stops are preferably provided such that when the pin 60' is forced as far as it can go, the dimple on the pin 60' is aligned with the transfer pin 30, and such that when the pin 60' is spring biased toward the second position, the pin 60' stops at a point when the transfer pin 30 is aligned with a flat 66 of the pin 60'.

In other embodiments, the dimple pin 60 can simply be rotated about its axis (without axial movement) to move the dimple 69 into and out of alignment with the transfer pin 30. In embodiments of this nature, the dimple pin 60 preferably is slidably received in the bore 180 (i.e., such that the pin 60 can be slidingly rotated within the bore 180).

In certain embodiments, the dimple pin 60 can be simultaneously moved axially and rotated to move the dimple 69 into and out of alignment with the transfer pin 30. For example, the dimple pin 60 can be threadingly received in the bore 180. In embodiments of this nature, at least one end of the dimple pin typically is accessible to an operator when the pin 60 is mounted in the bore 180.

In the embodiments of FIGS. 4A-4C, the safety key is adapted to extend through an opening in the side surface of the tool tang and a pen-click mechanism can be operatively coupled to the dimple pin 60 such that the pin can be moved alternately between its first and second positions by successively depressing the pen-click mechanism (e.g., in the manner of a mechanical ball-point pen wherein a reciprocal axial movement of an actuator exposes the pen tip and a following reciprocal axial movement of the actuator withdraws the pen tip into the barrel). Thus, the pen-click mechanism can be pressed once by an operator to move the dimple pin axially from its first position to its second position, whereafter pressing the pen-click mechanism a second time moves the dimple pin axially from its second position to its first position. In embodiments of this nature, the dimple pin can be operatively coupled to a pen-click mechanism of the nature described in U.S. Pat. No. 5,575,168 (Rosene et al.), the entire contents of which are incorporated herein by reference.

In certain alternate embodiments, the actuator 40 comprises a movable body 70 having a leading end 78 that is adapted to bear against (and cam with) the lock to move it into its locked position. This is perhaps best appreciated with reference to FIGS. 6A-7F, wherein the actuator 40 comprises a body 70 that can be a pin, plug, block, or various other types of bodies. The leading end 78 of the body 70 preferably is horizontally aligned with the bottom end 32 of the transfer member 30 when the transfer member is in the unlocked position. When the body 70 is forced against the thus-positioned transfer member 30, the leading end 78 of the body bears against (and cams with) the bottom end 32 of the transfer member 30 and thereby produces motion of the transfer member 30 toward the locked position. In more detail, when the body 70 is moved laterally from a first position (shown in FIGS. 6A, 6C, 7A, 7C, and 7E) to a second position (shown in FIGS. 6B, 6D, 7B, 7D, and 7F), the leading end 78 of the body bears against (and cams with) the bottom end 32 of the transfer member 30 such that the transfer member is moved vertically toward the locked position. The leading end 78 of the body 70 and the bottom end 32 of the transfer member 30 are configured such that when the body is forced against the transfer member, the force transmitted from the body to the transfer member has a component directed toward the transfer member's locked position (i.e., a vertical component). The leading end 78 of the body 70 and the bottom end 32 of the transfer member 30 define cam surfaces 79, 34 and/or cam corners 77 that can be provided in various configurations to facilitate the desired camming engagement.

In the embodiments of FIGS. 6A-7F, stops 72, 72' can be provided to limit the body's range of lateral movement within the bore 180. For example, the stops 72, 72' can be provided in the form of pins (e.g., which can be mounted in the body of the tool) extending into the bore 180. Alternatively, the bore 180 can be machined such that the wall 180W of the bore 180 (e.g., a shoulder projecting from the wall 180W) defines the stops 72, 72'. The stops allow an operator to readily determine that the body 70 is in its first position (and hence that the transfer member 30 is in the unlocked position) by sliding the body laterally toward stop 72 until the body can move no further in this direction (i.e., until the body 70 abuts the stop 72). Similarly, the operator can readily determine that the body 70 is in its second position (and hence that the transfer member 30 is in the locked position) by sliding the body laterally toward stop 72' until the body can move no further in this direction (i.e., until the body 70 abuts the stop 72').

Figure 6A:
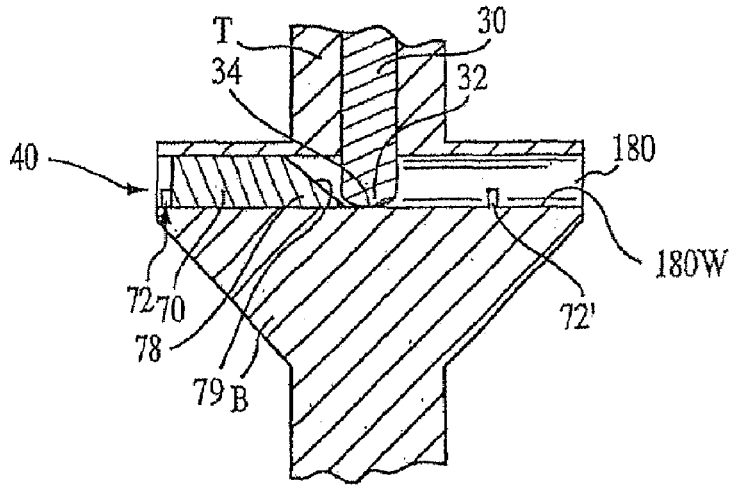
FIG. 6A is a broken-away side detail view of a press brake tool having a transfer member in an unlocked position in accordance with certain embodiments of the invention.
Figure 6B:
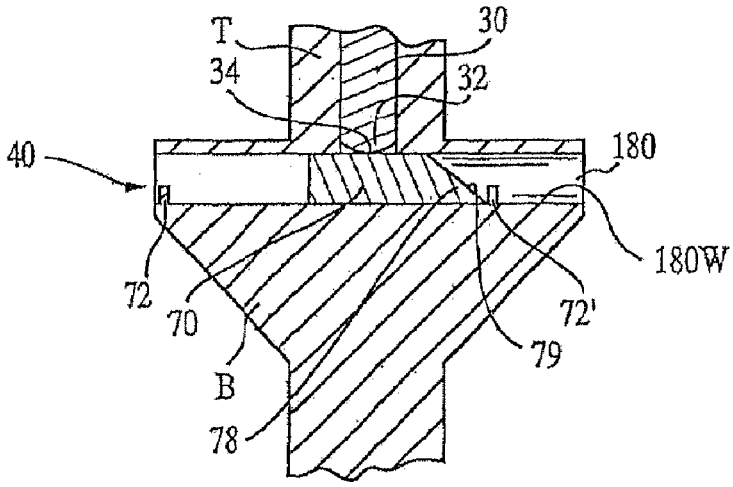
FIG. 6B is a broken-away side detail view of the press brake tool of FIG. 6A wherein the transfer member is in a locked position.

In the embodiments of FIGS. 6A and 6B, the cam surface 79 of the body 70 should be properly oriented in order to engage the transfer member 30. Thus, when the body 70 is a pin or another body that can rotate about its axis within the bore 180, it is desirable to provide the body 70 with a key that rides in a keyway (e.g., defined by the wall 180W) extending along the bore 180. Alternatively, a body 70 of this nature can be provided with a keyway that slides along a key (e.g., formed by a rail-like projection from the wall 180W) extending along the bore 180. Such key/keyway systems assure the pin is kept in the desired rotational orientation. Alternatively, the body 70 and the bore 180 can be provided in configurations (e.g., non-circular, cross-sectional configurations) that do not permit the body 70 to rotate about its axis when received in the bore 180.

Figure 6C:
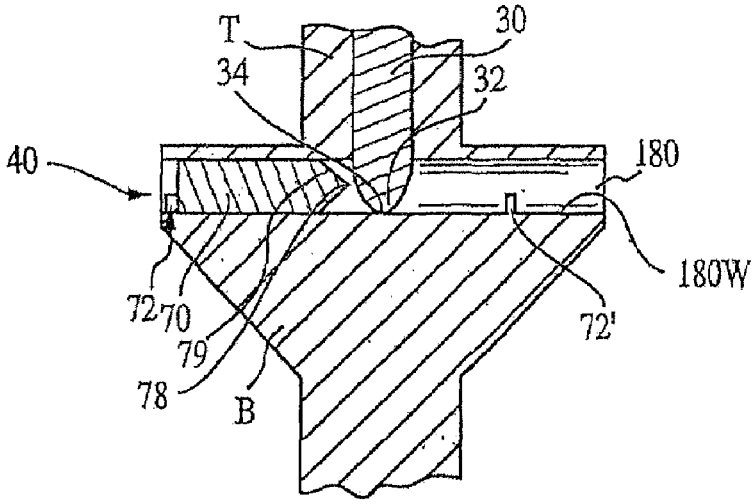
FIG. 6C is a broken-away side detail view of a press brake tool having a transfer member in an unlocked position in accordance with certain embodiments of the invention.
Figure 6D:
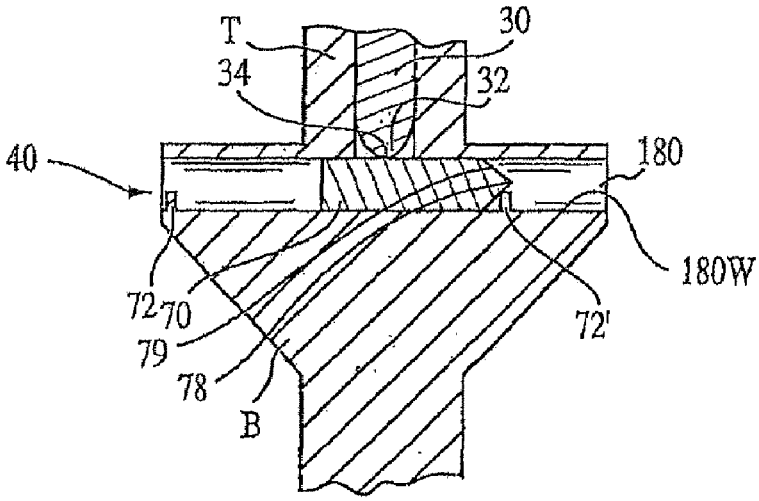
FIG. 6D is a broken-away side detail view of the press brake tool of FIG. 6C wherein the transfer member is in a locked position.
Figure 7A:
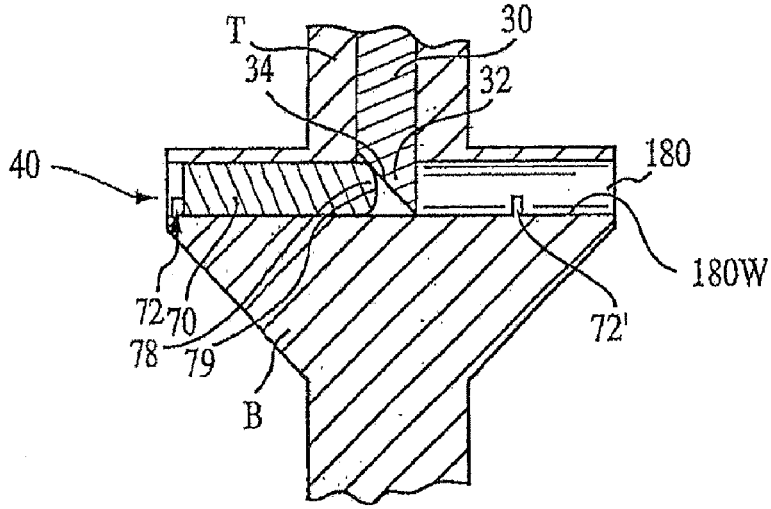
FIG. 7A is a broken-away side detail view of a press brake tool having a transfer member in an unlocked position in accordance with certain embodiments of the invention.
Figure 7B:
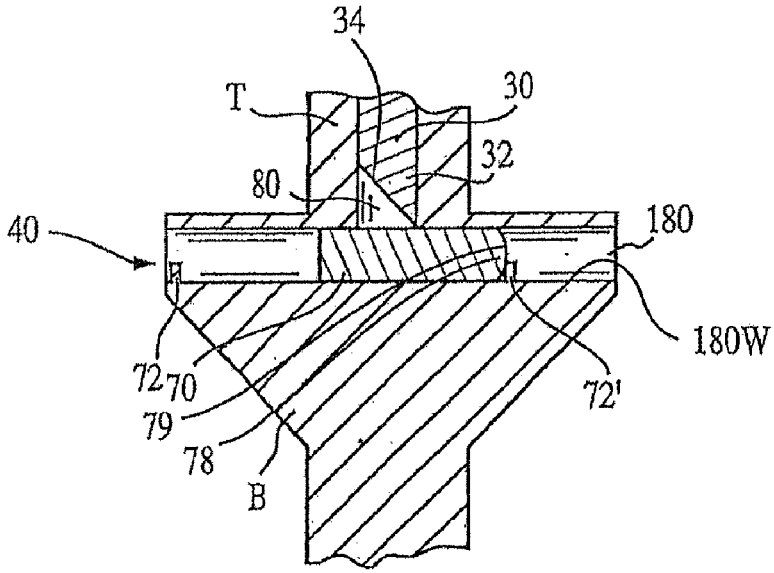
FIG. 7B is a broken-away side detail view of the press brake tool of FIG. 7A wherein the transfer member is in a locked position.
Figure 7C:
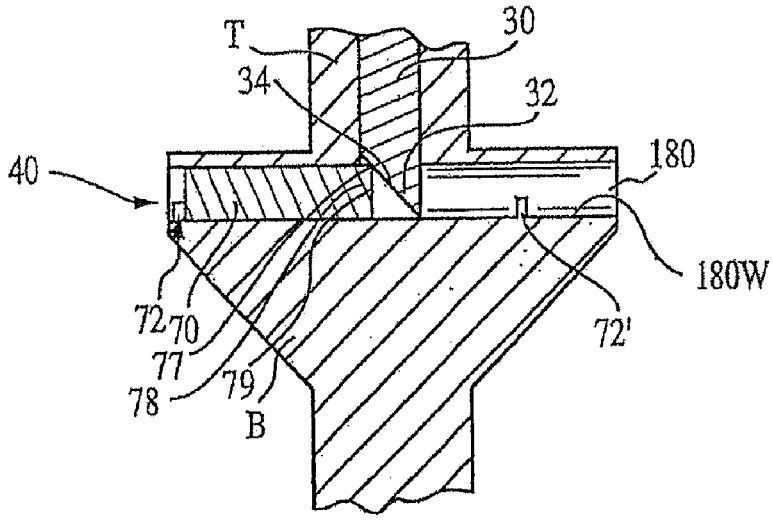
FIG. 7C is a broken-away side detail view of a press brake tool having a transfer member in an unlocked position in accordance with certain embodiments of the invention.
Figure 7D:
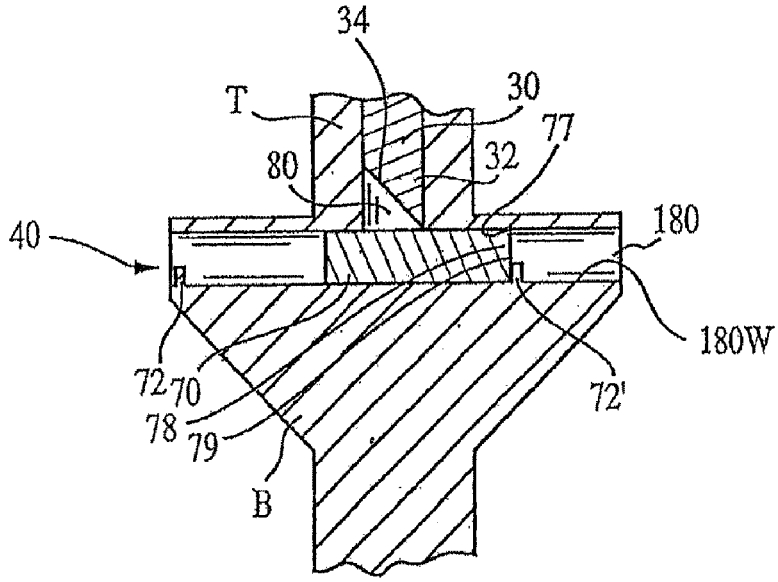
FIG. 7D is a broken-away side detail view of the press brake tool of FIG. 7C wherein the transfer member is in a locked position.

FIGS. 6A-6B depict an embodiment wherein the body 70 has a tapered leading end 78 and the transfer member 30 has a radiused end 32. Here, the tapered leading end 78 of the body 70 defines a straight-angle cam surface 79, although this surface 79 can alternatively be curved. As another alternative, the leading end 78 of the body 70 can be radiused, as shown in FIGS. 7A-7B and 7E-7F. As still another alternative, the leading end 78 of the body 70 can have a generally-conical configuration, as shown in FIGS. 6C-6D. As a further alternative, the body 70 can have a generally-planar leading end 78 (e.g., having a cam corner 77 that is adapted to bear against an end 32 of the transfer member 30), as shown in FIGS. 7C-7D.

Figure 7E:
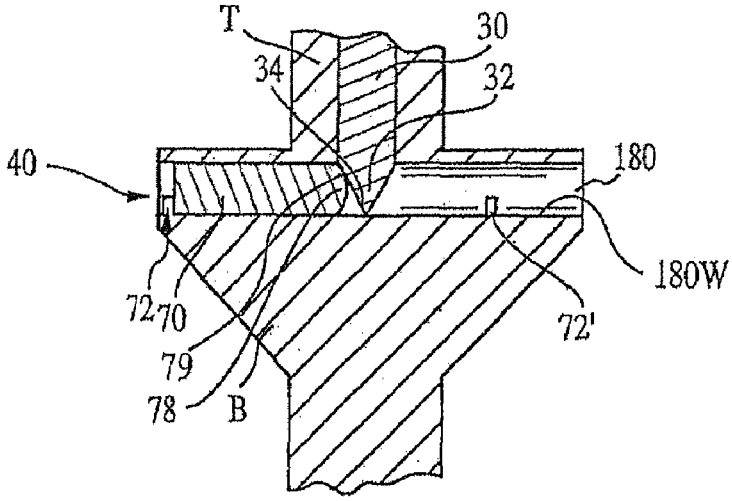
FIG. 7E is a broken-away side detail view of a press brake tool having a transfer member in an unlocked position in accordance with certain embodiments of the invention.
Figure 7F:
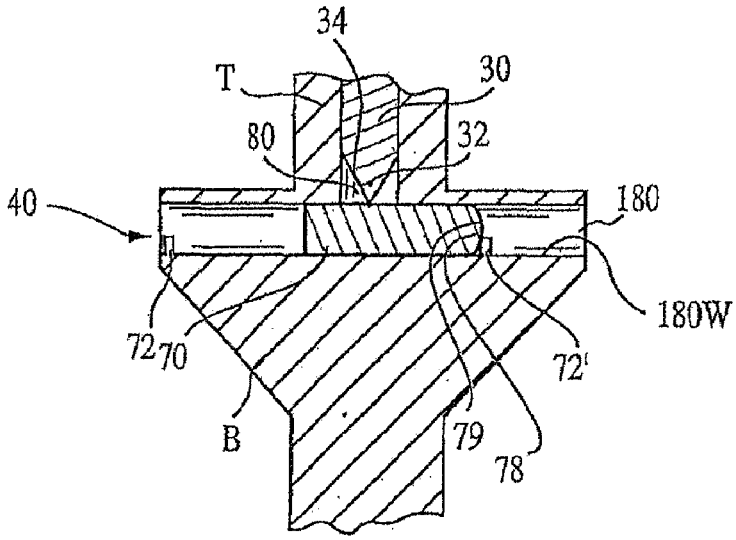
FIG. 7F is a broken-away side detail view of the press brake tool of FIG. 7E wherein the transfer member is in a locked position.

End 32 of the transfer member 30 can also be provided in various configurations to facilitate the desired camming engagement. In most cases, it will be preferable for this end 32 of the transfer member 30 to be tapered. For example, this end 32 of the transfer member 30 can be radiused, as shown in FIGS. 6A-6D. Alternatively, this end 32 of the transfer member 30 can have a generally-conical configuration, as shown in FIGS. 7E-7F. As another alternative, the cam surface 34 on this end 32 of the transfer member 30 can be provided at a straight angle, as shown in FIGS. 7A-7D.

The embodiments of FIGS. 6A-6D and 7E-7F are particularly desirable when the transfer member 30 is mounted in the bore 80 in such a way that the transfer member is free to rotate about its axis. In embodiments of this nature, rotation of the transfer member 30 about its axis will not prevent proper camming engagement of the transfer member 30 and the body 70.

To provide convenient locking and unlocking of the safety key 50, it will generally be preferred if one or two actuators are provided on each tool. As is perhaps best appreciated with reference to FIG. 2I, this permits the operator to lock and unlock the tool by operating no more than two actuators on each tool. When two actuators are provided on a single tool, the actuators 40 are preferably located adjacent the longitudinal sides of the tool. This makes it convenient for the operator to firmly grip both sides of the tool while operating the actuators.

Thus, the invention provides a variety of embodiments wherein a press brake tool is provided with a lockable safety key. In some of these embodiments, the safety key is resiliently biased toward its extended position. This can be accomplished in various ways. For example, the safety key can be resiliently biased toward its extended position by a spring that bears directly against the safety key. Alternatively, a body adjacent the safety key can be spring loaded and adapted to bear against the safety key so as to resiliently bias the safety key toward its extended position.

FIGS. 3A-4C and 9A-10 exemplify embodiments wherein the safety key is resiliently biased by a spring that bears directly against the safety key. Here, the safety key 50 (which can be a lock pin) defines a spring pocket 130 in which a spring can be provided. The safety key 50 is mounted in a bore 280 extending laterally through the tool tang T. As is perhaps best appreciated with reference to FIGS. 3C and 4C, the bore 280 has a small-diameter region 282 and a large-diameter region 286, and a shoulder 284 bounds the large-diameter region. This shoulder 284 limits the safety key's range of lateral motion within the bore 280. To mount the safety key 50 in the bore 280, the engagement portion 59 of the safety key is advanced into the large-diameter region 286 of the bore 280 until the safety key's shoulder 55 engages the shoulder 284. An end cap 120 is then secured to the tool tang T to close the large-diameter region 186 of the bore 280, such that the spring in the pocket 130 is compressed between the end cap 120 and the wall 140 of the safety key 50. Thus, the spring in the spring pocket 120 bears directly against the safety key 50 and resiliently biases it toward its extended position.

FIG. 2I exemplifies certain embodiments wherein a spring-loaded body adjacent the safety key 50 bears resiliently against the safety key. Here, the safety key 50 is engaged by a plurality of transfer members 30. Preferably, at least one transfer member 30 is a spring-loaded transfer member (which is biased vertically by a spring, as can be appreciated with reference to FIGS. 2J-2L) and at least one other transfer member 30 is a locking transfer member (which is adapted to lock the safety key in its extended position, as described). With reference to FIGS. 2K-2L, the illustrated spring-biased transfer member 30 is mounted in a blind bore 380. This transfer member can be a spring plunger (e.g., a Vlier-type spring plunger). The spring-loaded transfer member 30 bears against (and cams with) the cam surface 52 of the safety key 50, thereby resiliently biasing the safety key toward its extended position.

With reference to FIGS. 2J-2L, it will be appreciated that FIG. 2J depicts a bore 380 that opens through surface 19 of the tool tang T. The illustrated bore 380 includes wide bore portion 382 and narrow bore portion 384. The transfer member 30 is received in the wide bore portion 382 and an end portion of spring 177 is received in narrow bore portion 384. In FIG. 2K, the transfer member 30 can be a solid body such that the bottom of the transfer member 30 provides a seat for the spring 177. Alternatively, the interior of the transfer member 30 can provide a seat for the spring 177, as depicted in FIG. 2L. Various embodiments of this nature can be employed.

In the embodiment of FIG. 2I, it is preferable for one or two transfer members 30 to be locking transfer members, while the rest of the transfer members 30 are simple spring-loaded transfer members (i.e., spring-loaded transfer members that are not adapted for locking the safety key). To provide convenient locking and unlocking of the safety key, it is generally preferred for one or two locking transfer members/actuators 40 to be provided on each tool. Thus, the operator is not required to operate more than two actuators to lock and unlock the safety key. Preferably, the two transfer members adjacent the sides of the tool are locking transfer members, while the rest of the transfer members are simple spring-loaded transfer members.

Thus, the safety key can be resiliently biased toward its extended position in various ways. It is to be understood, however, that the safety key is not required to be resiliently biased. For example, this is not strictly required in embodiments wherein the safety key has a cam locking mechanism, as described above (e.g., with reference to FIGS. 2-2L and 8A-8B). In embodiments of this nature, when the transfer member is forced against the safety key, the resulting camming action will move the safety key into its extended position, even if the safety key is not resiliently biased toward this position. Likewise, when the safety key is forced toward its retracted position, the resulting camming action will move the transfer member into the unlocked position. Thus, the invention provides certain alternate embodiments wherein the safety keys is not resiliently biased toward its extended position.

The safety key has an engagement portion 259 that is adapted for engaging the tool holder (e.g., extending into a safety slot S/S of the tool holder or moving into vertical alignment with a shelf 16.3 of the tool holder). Typically, the engagement portion 259 of the safety key 50 is a distal end 59 thereof. In certain preferred embodiments, the engagement portion 259 has a tapered leading region 57. This tapered leading region 57 can facilitate advancing the tool into the tool holder when the lock is in the unlocked position, as described below. Further, the engagement portion 259 of the safety key 50 includes both a tapered leading region 57 and a tapered trailing region 53 in certain preferred embodiments. The tapered trailing region 53 can facilitate removing the tool from the tool holder when the lock is in the unlocked position, as described below.

Figure 8A:
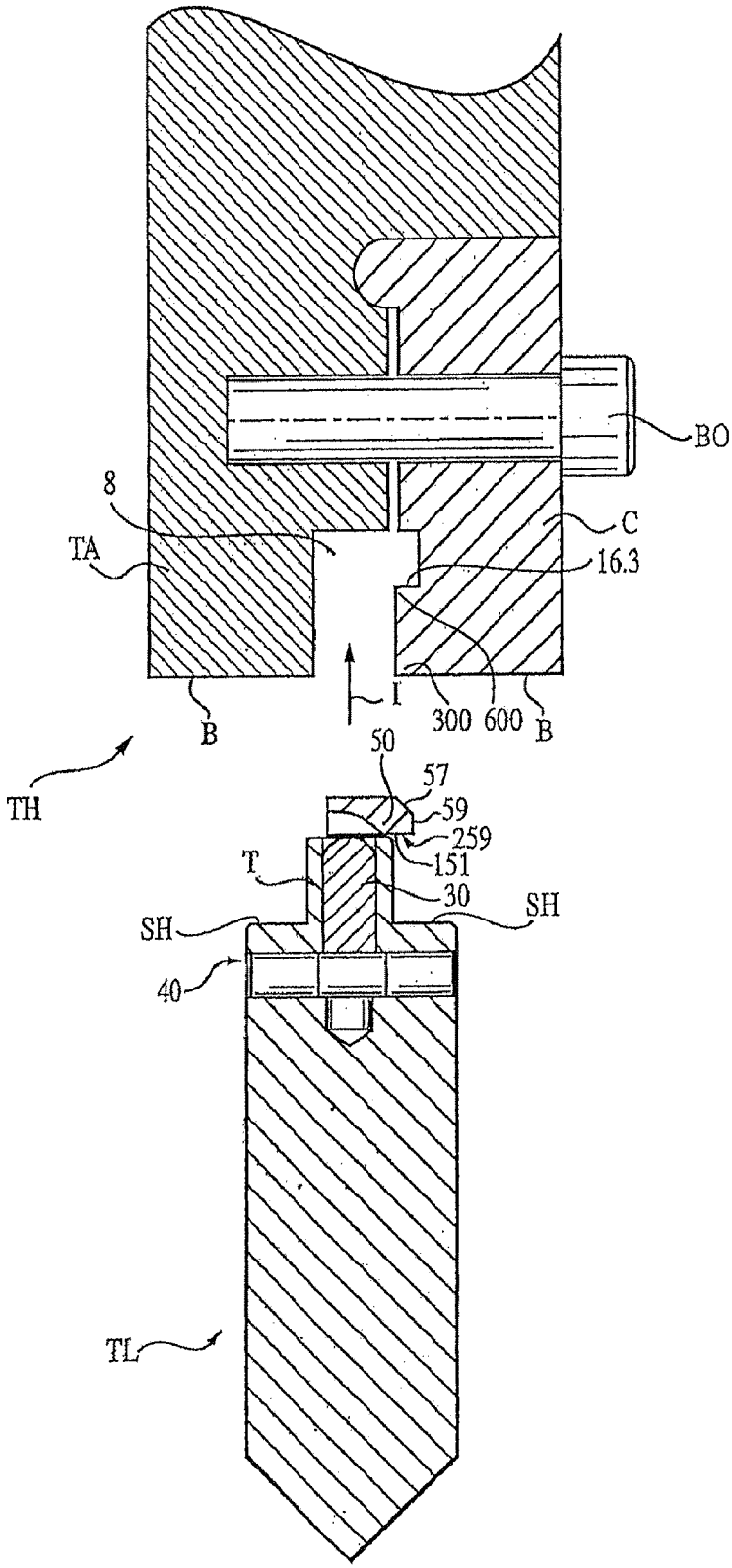
FIG. 8A is a cross-sectional side view, partially broken away, of a press brake tool and tool holder, prior to mounting the tool in the tool holder, in accordance with certain embodiments of the invention.
Figure 8B:
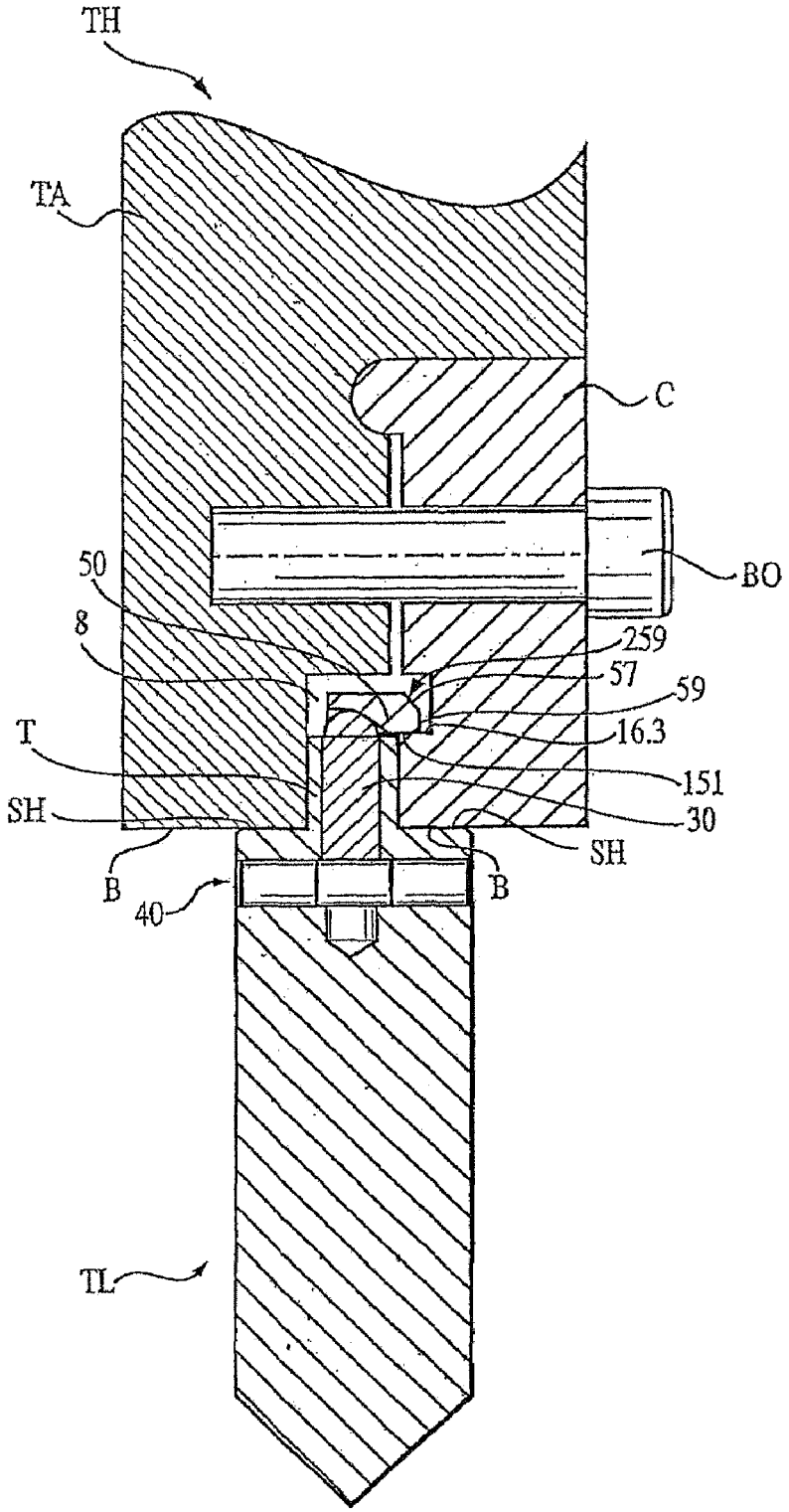
FIG. 8B is a cross-sectional side view, partially broken away, of the press brake tool and tool holder of FIG. 8A wherein the tool is operatively mounted in the tool holder.

Reference is now made to FIGS. 8A-8B, which depict a highly advantageous "click-in/slide-out" embodiment of the invention. Here, the engagement portion 259 of the safety key 50 has a tapered leading region 57 and a generally-planar trailing region 151. The tool TL is mounted by advancing it vertically in the direction of arrow I toward the recess 8 of the tool holder TH. As the engagement portion 259 of the safety key 50 approaches the recess 8, the tapered leading region 57 contacts a corner 300 of the tool holder TH. This corner 300 cams with the tapered leading region 57 of the safety key 50 and moves it into its retracted position as the tool TL is moved further into the recess 8. Once the trailing region 151 of the safety key's engagement portion 259 is moved vertically beyond the tool holder's shelf 16.3, the resiliently-biased safety key 50 moves into its extended position and engages the tool holder TH (i.e., moves into vertical alignment with the shelf 16.3). Then, with the load receiving shoulders SH of the tool TL flush against the load-transmitting surfaces B of the plate C and beam TA, the bolt BO is tightened to secure the tang T of the tool TL between the clamp and the table. The safety key 50 can then be locked in its extended position by operating the actuator 40 (as described above) to move the transfer member 30 into locking engagement with the safety key. When the tool TL is to be removed from the holder TH, the plate C is loosened (by loosening the bolt BO), and the tool is withdrawn by sliding it longitudinally out of the holder (the tool should be gripped firmly by the operator during withdrawal).

Turning now to FIGS. 9A-9B, it can be appreciated that the invention also provides highly advantageous "click-in/click-out" embodiments. Here, the engagement portion 259 of the safety key 50 has both a tapered leading region 57 and a tapered trailing region 53. The tool TL is mounted by advancing it vertically in the direction of arrow I into the recess 8 of the tool holder TH. As the tool tang T is moved vertically within the recess 8, the engagement portion 259 of the safety key 50 approaches a corner 400 of the tool holder TH. As the tool TL is moved further into the recess 8, this corner 400 cams with the tapered leading region 57 of the safety key 50 and moves it into its retracted position. Once the trailing region 53 of the safety key's engagement portion 259 is moved vertically beyond surface 510 of the tool holder's safety slot SIS, the resiliently-biased safety key 50 moves into its extended position and engages the tool holder TH (by moving into the safety slot S/S, i.e., moving into vertical alignment with the surface 510). The safety key 50 can be locked in this position by operating the actuator 40 to move the transfer member 30 into locking engagement with the safety key. When the tool is to be removed from the holder, the actuator is operated, while firmly gripping the tool, to unlock the safety key 50. The transfer member 30 thus moves out of locking engagement with the safety key. The tool can then be withdrawn vertically from the holder. When the tool is withdrawn in this manner, a corner 500 of the tool holder cams with the tapered trailing region 53 of the safety key 50' and moves it into its retracted position, allowing the tool TL to be withdrawn entirely from the holder.

Click-in/click-out tool embodiments are particularly advantageous in that they can be removed vertically. When a long tool is to be replaced, it can be difficult to slide the tool from its holder due to the proximity of neighboring forming tools; these, in turn, may themselves have to be removed in order to complete the tool exchange process. Similar problems can also be caused by neighboring plates.

It is to be understood that the invention provides a tool having a particularly advantageous elongated safety key 50, as typified in FIG. 2I, which is inventive in its own right. Here, the safety key 50 is elongated longitudinally and extends along a substantial length of the tool tang. In certain embodiments, the elongated safety key extends along a major portion (i.e., at least fifty percent) of the longitudinal length of the tool tang. In one embodiment, the elongated safety key extends along at least 75% of the length of the tool. For example, the elongated safety key may extend along substantially the entire longitudinal length of the tool tang. While this is not required, the longitudinal length of the safety key in some cases is greater than the lateral width of the tool tang (and can be at least about twice as great, and even at least about three times as great). The present safety key 50 has a highly advantageous one-piece construction (i.e., the safety key is a single, integral body or "tang"). This safety key 50 is mounted on the tool for movement between extended and retracted positions (shown respectively in FIGS. 2H and 2G). In certain embodiments of this nature, the safety key 50 has a longitudinal length of at least about 3 cm, preferably at least about 5 centimeters, perhaps more preferably at least about 8 centimeters, and in some cases between about 15 cm and about 60 cm. In certain preferred embodiments, the invention provides a press brake tool having a single elongated safety key 50 that is engaged by a plurality of transfer members 30, which each are adapted to bias the safety key toward its extended position and/or apply a locking force to the safety key when it is desired to lock the safety key in its extended position (though, in the present elongated safety key embodiments it is not required that the safety key be lockable). FIG. 2I depicts one embodiment of this nature. The embodiment typified in FIG. 2I is only one manner in which a safety key of this nature can be employed.

The invention provides certain alternate embodiments (not shown), wherein the press brake tool has two or more safety keys that are adapted to engage, for example: two or more safety slots in the tool holder; two or more shelves in the tool holder; or at least one safety slot and at least one shelf in the tool holder. In these embodiments, at least one of the safety keys is lockable.

FIGS. 11A-11D show a press brake tool 1100 in accordance with certain embodiments of the present invention. The tool 1100 includes a workpiece-engagement tip 1105. The tool 1100 can be of the Wila style, American style, European style, or any other suitable style of press brake tooling. The tool 1100 preferably has at least one load-bearing surface LB (i.e., a surface adapted to receive downward or upward force, or support, from a load-bearing surface LD of a tool holder TH). Thus, the load-bearing surface LB of the tool preferably is adapted to directly engage a load-bearing surface LD of a tool holder. The tool holder can be on a down-acting press or an up-acting press.

The tool 1100 can have a vertical axis VA, which preferably is oriented approximately perpendicular in relation to the tool's load-bearing surface LB. When the term "vertical" is used, it refers to a direction/axis that this oriented perpendicular relative to the tool's load-bearing surface LB. Thus, even when the tool is held at an angle, the leading and trailing cam surfaces of its safety key can be said to be "offset from vertical", since "vertical" here is based on the vertical axis of the tool. A similar convention is used for the term "horizontal". This term refers to a direction/axis that is oriented parallel relative to the tool's load-bearing surface LB.

Figure 11A:
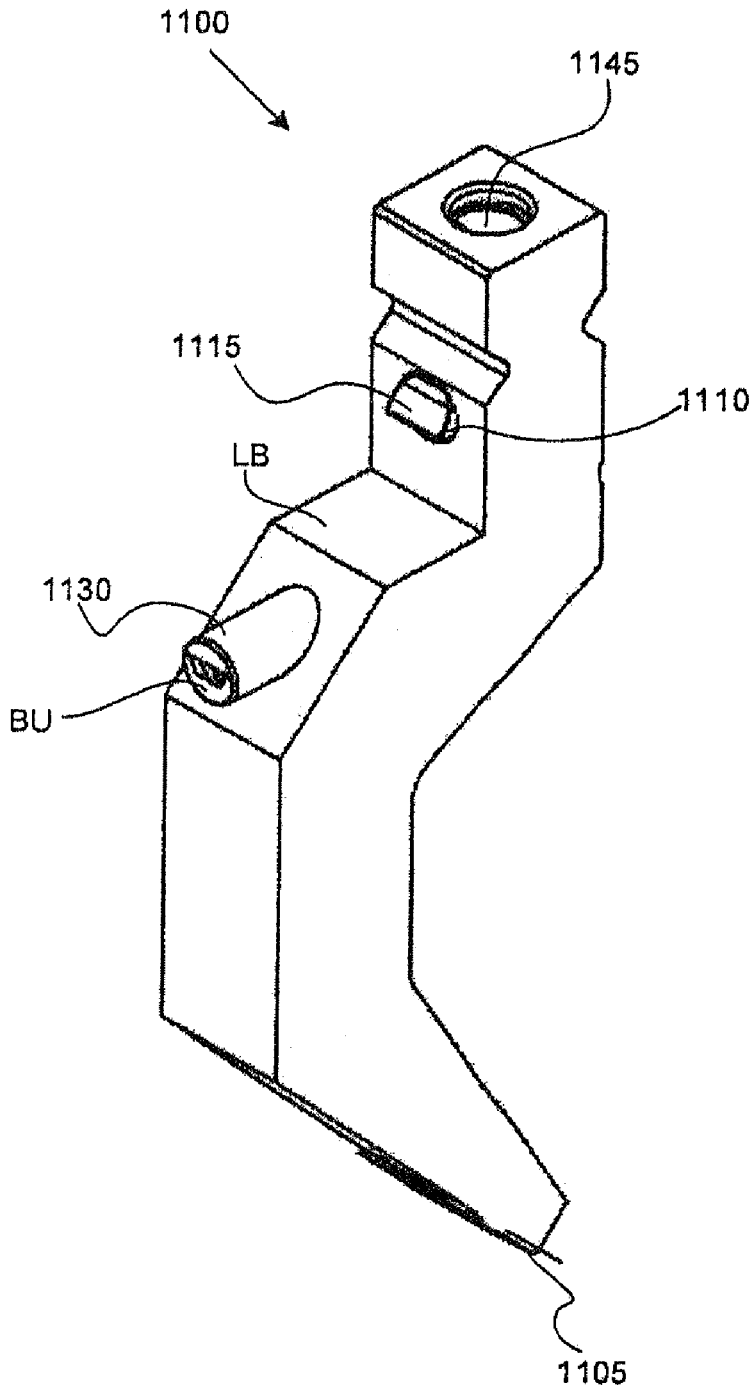
FIG. 11A is perspective view of a press brake tool in accordance with certain embodiments of the present invention.
Figure 11B:
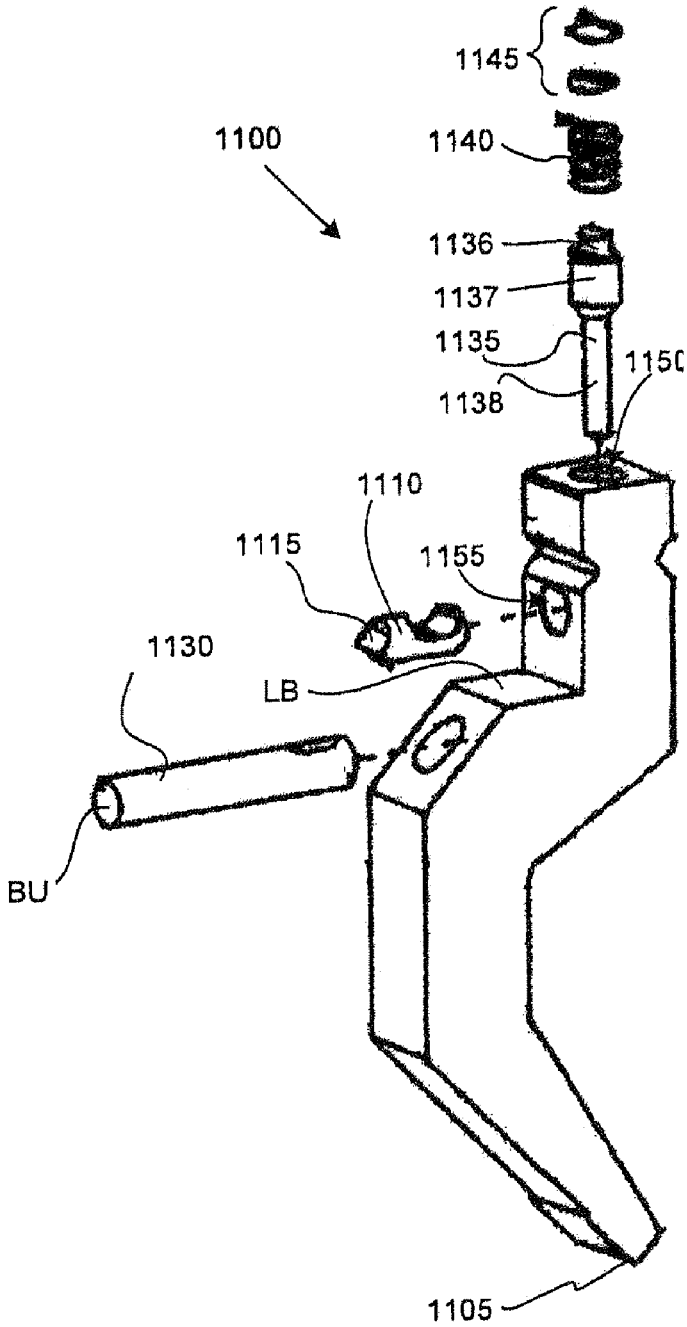
FIG. 11B is an exploded perspective view of the press brake tool of FIG. 11A.
Figure 11D:
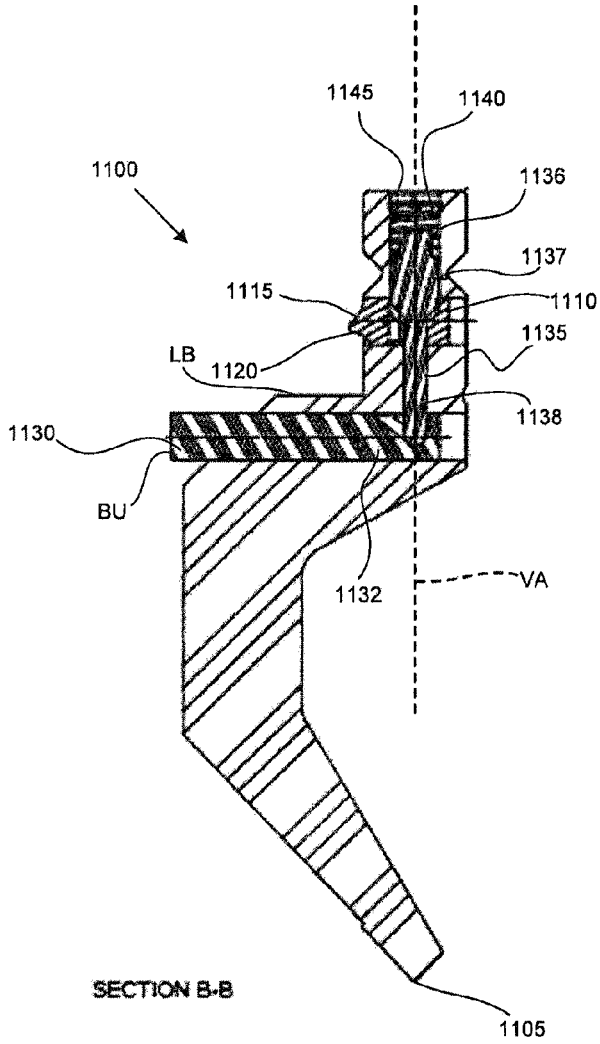
FIG. 11D is a cross-sectional view of the press brake tool of FIG. 11A according to section B-B shown in FIG. 11C.
Figure 11C:
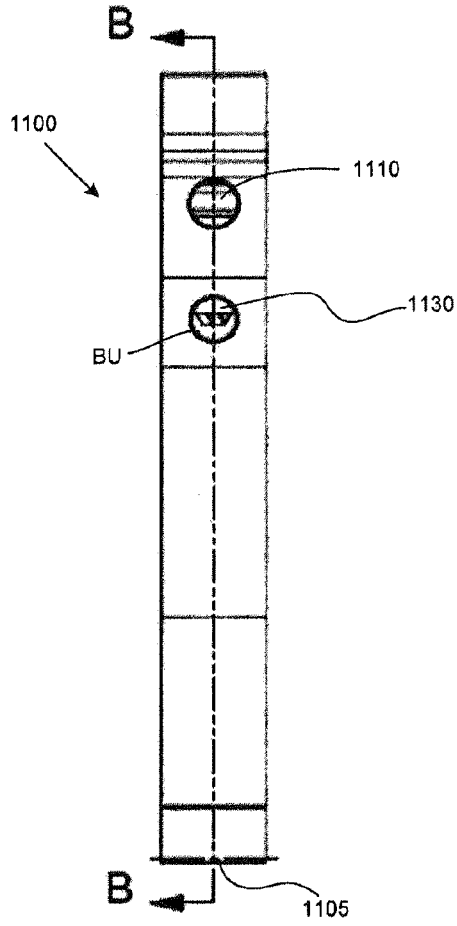
FIG. 11C is a side view of the press brake tool of FIG. 11A.

The press brake tool 1100 of FIGS. 11A-11D includes a retractable safety key 1110. The illustrated safety key 1110 is adapted to be mounted in a bore 1155 defined by the tool. Like other safety keys discussed in the present disclosure, the safety key 1110 of FIGS. 11A-11D can be positioned in both extended and retracted positions (and preferably in any position laterally therebetween). The safety key 1110 in FIGS. 11A and 11D is shown in the extended position. In some embodiments, the safety key 1110 can be locked in its extended position, e.g., by any means discussed herein or other suitable means. Thus, some embodiments involve a lock that can positively lock the safety key in its extended position. When the safety key 1110 is locked in its extended position (and is received in a safety groove of a tool holder), the safety key prevents the tool 1100 from falling inadvertently from the tool holder. When the safety key 1110 is unlocked, it is movable between its extended and retracted positions.

Figure 12A:
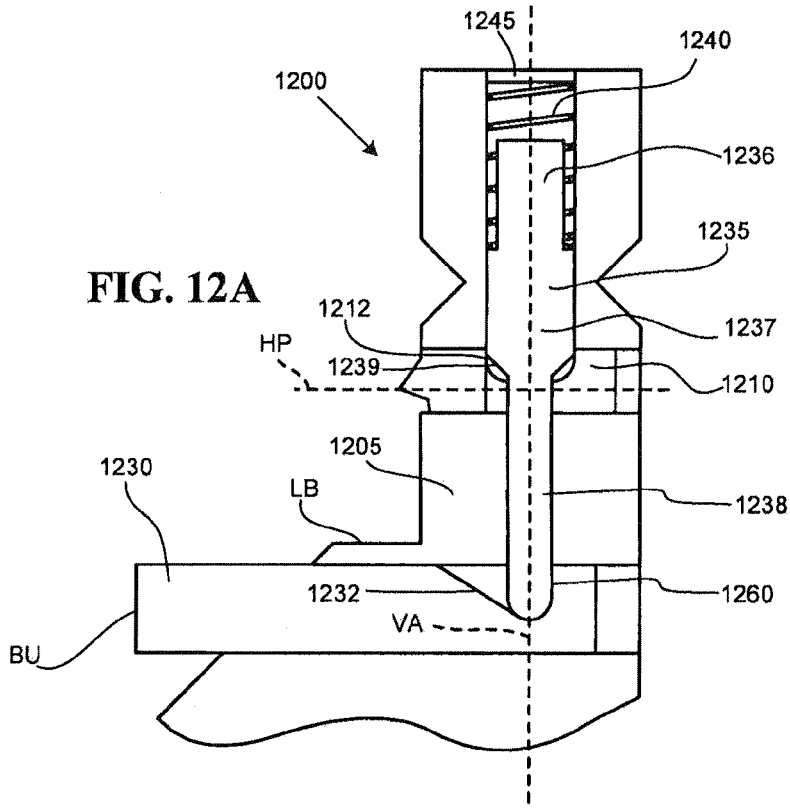
FIGS. 12A-12B are partially broken-away schematic views of a press brake tool in accordance with certain embodiments of the invention.
Figure 12B:
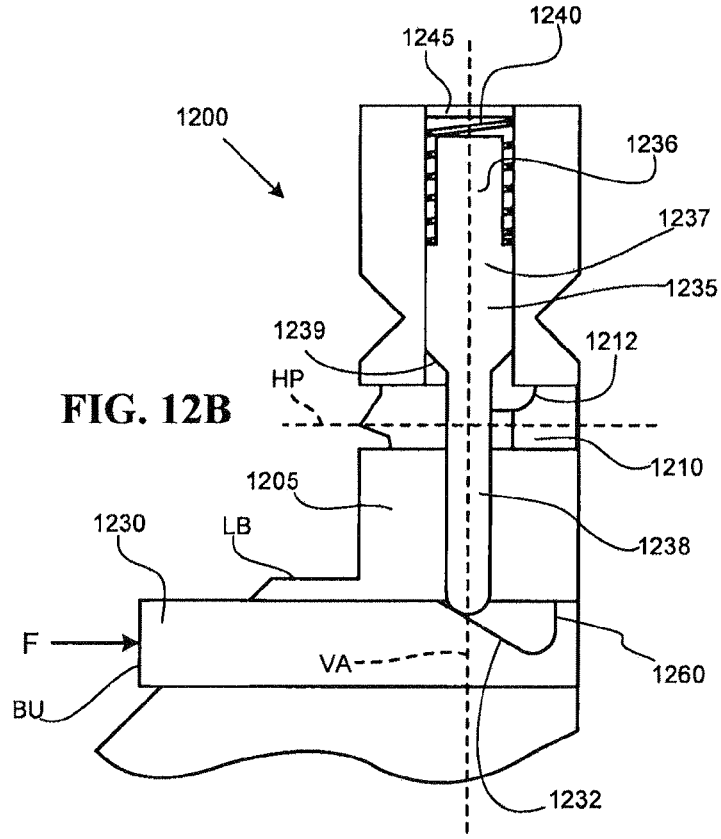

FIGS. 12A-12B show a safety key 1210 similar to that of FIGS. 11A-11D in extended and retracted positions, respectively. In particular, the safety key 1210 in FIG. 12A is positively (e.g., rigidly) locked in its extended position, while the safety key 1210 in FIG. 12B is unlocked and in its retracted position. In FIG. 12A, the safety key is positively locked in its extended position by virtue of the transfer member being rigidly lodged between the safety key and a wall of the tool's shank.

Figure 14:
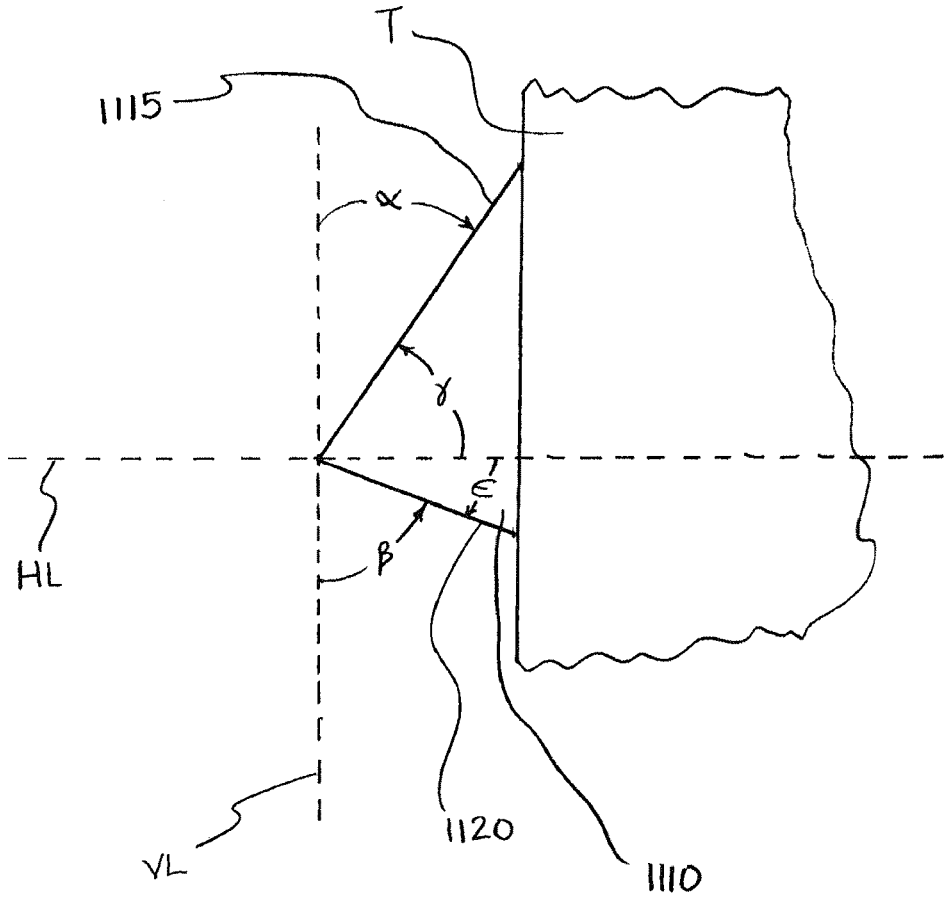
FIG. 14 is a broken-away schematic side detail view of a safety key on a press brake tool in accordance with certain embodiments.

Referring again to FIGS. 11A-11D, the safety key 1110 has a distal end (or an "engagement portion") that includes a tapered leading region 1115 and a tapered trailing region 1120. The tapered leading region 1115 is adapted to facilitate advancing the tool 1100 vertically (e.g., upwardly) into the tool holder. The tapered trailing region 1120 is adapted to facilitate withdrawing the tool 1100 vertically (e.g., downwardly) from the tool holder. In some embodiments, the tapered leading region 1115 has a generally planar leading cam surface that forms a positive angle $\gamma$ with the horizontal when the tool 1100 is operatively mounted in the tool holder. The angle $\gamma$ preferably is an acute, positive angle. For example, the tapered leading region 1115 can optionally form an angle $\gamma$ of between about 5° and about 80°, or between about 50° and about 60°, such as about 55°, with the horizontal. Additionally or alternatively, the tapered trailing region 1120 can have a generally planar trailing cam surface that forms a negative angle $\epsilon$ with the horizontal. The angle $\epsilon$ preferably is an acute, negative angle. For example, the tapered trailing region 1120 can optionally form an angle $\epsilon$ of between about −5° and about −80+, or between about −15° and about −25°, such as about −20°, with the horizontal. This is best seen in FIG. 14, wherein there is shown a horizontal axis HL passing through the safety key (at a point between, optionally at an intersection of, the safety key's leading and trailing regions) and a vertical axis VL passing through a distal end of the safety key.

In certain embodiments, the tapered leading region 1115 of the safety key defines a leading cam surface that is offset from vertical by a desired angle $\alpha$ (a "leading angle"). In these embodiments, the tapered trailing region of the safety key defines a trailing cam surface that is offset from vertical by a different angle $\beta$ (a "trailing angle"). These "offset angles" are shown in FIG. 14. In some embodiments of this nature, the magnitude of the leading angle is smaller than that of the trailing angle. This can provide a safety key that is advanced easily into the recess of a tool holder, and does not fall instantly from the tool holder when the safety key is unlocked (but rather requires a person to also pull the tool downwardly to remove the tool vertically from the tool holder). In some embodiments involving different leading and trailing angles, the lock on the safety key is not required (but rather is optional).

In certain embodiments, the tapered leading region 1115 is offset from vertical by a leading angle $\alpha$ of at least 5°, such as about 10° to 85°, and preferably about 30° to 40°. For example, the tapered leading region 1115 can be optionally be offset from vertical by a leading angle $\alpha$ of about 35°. Additionally or alternatively, the tapered trailing region 1120 can be offset from vertical by a trailing angle $\beta$ of at least 5°, such as about 10° to 85°, and preferably about 65° to 75°. For example, the tapered trailing region 1120 can optionally be offset from vertical by a trailing angle $\beta$ of about 70°. The angle by which the tapered leading region 1115 is offset from vertical and the angle by which the tapered trailing region 1120 is offset from the tool's vertical axis VA are not supplementary angles (i.e., the sum of the two angles' degree measurements does not equal 180°).

In the illustrated embodiment, the tapered leading region 1115 and the tapered trailing region 1120 meet at a distal edge of the safety key. The illustrated distal edge is straight and extends from one side of the safety key 1110 to the other. Thus, in FIGS. 11A-11D, the distal edge of the safety key is aligned generally horizontally when the tool 1100 is mounted in the tool holder. These details, however, are by no means required.

In some embodiments, a horizontal plane HP extends through, and is at least generally parallel to, a distal edge of the safety key. Reference is made to FIGS. 12A and 12B. Here, the angles noted above can also be measured conveniently relative to this horizontal plane HP.

When inserting the illustrated tool 1100 into the tool holder, the safety key 1110 is unlocked. When the safety key 1110 is unlocked, it preferably can be in the extended position, the retracted position, or any position laterally therebetween. To the extent the safety key 1110 is not fully retracted inside the tool's shank, the tapered leading region 1115 of the safety key can contact a first surface of the tool holder (which surface preferably is defined by a generally downwardly-facing shoulder 400 of the tool holder) as the tool is moved vertically (e.g., upwardly) into the tool holder's recess. As the tool is moved further into the recess, the tapered leading region 1115 can cam with this surface/shoulder 400, thereby moving the safety key 1110 laterally toward its retracted position. This camming action moves the safety key 1110 out of the way so the tool 1100 can be fully inserted into the recess of the tool holder. A safety key 1110 having a tapered leading region with a surface inclined about 50° to 60° from horizontal is preferred, and an angle of about 55° has given good results. However, this merely reflects one exemplary embodiment, and the angle can be varied.

Once the tool 1100 is inserted in the recess of the tool holder, the safety key 1110 can be moved to its extended position and locked. Further, if the tool holder has a moveable clamp, the clamp can be closed upon the tool, thereby exerting clamping force on the tool's shank. With the tool 1100 thus secured in the tool holder, the press brake can be used without fear of the tool 1100 falling inadvertently from the tool holder.

After use of the tool 1100 is completed, it can be removed from the tool holder. If the tool holder has a clamp, it can be loosened, thereby removing (or at least reducing) the clamping force on tool 1100. Even with a loosened clamp, the tool 1100 is retained in the tool holder by the extended safety key 1110. When an operator is ready to remove the tool 1100 from the tool holder, he or she unlocks the safety key 1110. With the safety key 1110 unlocked, the operator pulls the tool 1100 vertically (e.g., downwardly). As the resulting force (e.g., downward force) is exerted on the tool 1100, the tapered trailing region 1120 bears against (and cams with) a second surface of the tool holder (which surface preferably is defined by a generally upwardly-facing shoulder 500 of the tool holder), thereby moving the safety key 1110 laterally toward its retracted position far enough that the tool 1100 can be removed vertically (e.g., downwardly) from the tool holder. A safety key 1110 with a tapered trailing region 1120 having a surface inclined about −15° to −25° from horizontal is preferred, and an angle of about −20° has given good results. However, this simply corresponds to one exemplary embodiment, and the angle can be varied.

The preferred angles noted above can be used to ensure that simply unlocking the safety key 1110 (at such time as the tool is mounted in a tool holder) does not cause the safety key to move to its retracted position. This prevents the tool 1100 from being released instantaneously upon simply unlocking the safety key. In embodiments of this nature, the lock is preferred. However, it is not required, and may be omitted in some of these embodiments.

The tool 1100 shown in FIGS. 11A-11D has a lock assembly for positively locking the safety key in its extended position. The illustrated lock assembly includes an actuator 1130, a transfer member 1135, and a spring 1140. The spring 1140 can be a compression spring, a spring clip, or any other resilient-biasing member. When assembled, the spring 1140 can be compressed between capping hardware 1145 and the transfer member 1135. The transfer member 1135 can be a rod, block, or assembly that includes a spring-abutting portion (or "spring seat") 1136, a base portion 1137, and an extending portion 1138. Each portion of the transfer member 1135 can optionally have a generally circular cross-section (taken in a horizontal plane). In some embodiments, one or more portions of the transfer member have a non-circular cross-section (e.g., a polygonal cross-section). Any one or more features of the other transfer members discussed above can be incorporated into a lock assembly like that of FIGS. 11A-11D.

Figure 15:
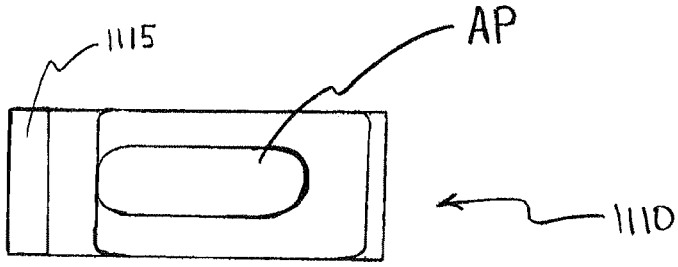
FIG. 15 is a top view of a safety key that can be used on a press brake tool in accordance with certain embodiments.

The capping hardware 1145 can hold the spring 1140 and the transfer member 1135 within a bore 1150. The illustrated bore 1150 extends along a vertical axis VA of the tool. The transfer member's extending portion 1138 can extend from the base portion 1137 (e.g., in the general direction of the tool's tip). The transfer member 1135 can pass through an aperture AP defined by the safety key 1110. The aperture AP of one exemplary safety key design is shown in FIG. 15. A center axis of the transfer member 1135 can be approximately coplanar with (e.g., lying generally in the same vertical plane as) a center axis of the safety key 1110, i.e., when both are operatively assembled within their respective bores 1150, 1155. One end (e.g., a bottom end) of the transfer member's extending portion 1138 can contact a cam surface 1132 of the actuator 1130. In some embodiments, the cam surface 1132 is defined by an end of the actuator. In the embodiments of FIGS. 11A-13, the cam surface 1132, 1232, 1332 bounds a groove in the actuator, and the groove can be configured to receive one end of the transfer member. Such a groove can advantageously limit the lateral movement of the actuator, so as to maintain the actuator within a desired range of lateral movement (e.g., to prevent the actuator from coming off the tool).

The actuator 1130 can be generally cylindrical and can be disposed slidably within a bore defined by the tool. A center axis of the actuator 1130 can be approximately coplanar with a center axis of the transfer member 1135 and/or a center axis of the safety key 1110. In some embodiments, the actuator 1130 can have a non-circular cross-section (e.g., a polygonal cross-section). Any one or more features of the other actuators discussed above can be incorporated into a lock assembly like that of FIGS. 11A-11D.

FIGS. 12A-12B show how a lock assembly similar to that of FIGS. 11A-11D can be used in a press brake tool 1200. FIG. 12A shows the lock assembly in a steady state position, with no external forces applied. In this position, the lock assembly biases the safety key 1210 into an extended, locked position. Here, a spring 1240 exerts a force (e.g., a force directed generally toward the tool's tip) on the transfer member 1235, thereby pressing one end (e.g., a bottom end) of the transfer member 1235 against a cam surface 1232 of the actuator 1230. The end of the transfer member 1235 thus bears against (and cams with) the actuator's cam surface 1232, causing the actuator to move (to the left as seen in FIGS. 12A and 12B) until the end of the transfer member comes to rest against an end portion (e.g., a bottom portion) of the cam surface 1232. In this steady state position, the actuator 1230 of FIGS. 12A-12B protrudes a maximum distance (within its range of lateral motion) from the body of the tool. In some embodiments where the actuator 1130 includes a groove, the groove is bounded by a back wall 1260, which can prevent the actuator 1230 from protruding any further from the tool's body. In the steady state position, the base portion 1237 of the transfer member nests in a recess 1212 defined by the safety key 1210 so as to lock the safety key in its extended position, and the extending portion of the transfer member passes through the aperture AP defined by the safety key 1210. In this way, the lock assembly can positively lock the safety key 1210 in its extended position in the absence of external force on the safety key or actuator.

Various lock assembly features can be provided. For example, in some embodiments, the recess defined by the safety key 1210 is bounded by a generally U-shaped surface (and/or a generally U-shaped wall or other structure) of the safety key 1210. Preferably, the aperture AP extends entirely through the safety key 1210. When the tool is operatively assembled, its vertical axis may pass through the aperture AP defined by the safety key. In some embodiments (when the tool is operatively assembled), the safety key 1210 entirely surrounds the transfer member 1235. Thus, the elongated extending portion of the transfer member may extend through the aperture AP in the safety key in much the same way that thread can be passed through the eye of a needle.

FIG. 12B shows the lock assembly in an unlocked position, with the safety key 1210 in its retracted position. As indicated by arrow (F), force is being applied to a button BU of the actuator 1230. Therefore, the actuator 1230 and the cam surface 1232 have moved laterally (to the right as seen in FIG. 12B), which has caused the cam surface 1232 of the actuator to cam with the end of the transfer member, thereby moving the transfer member in a direction generally away from the tool's tip (upwardly as seen in FIG. 12B). To accomplish this movement of the transfer member 1235, the force (F) must be great enough to overcome the force of the spring 1240. With the transfer member 1235 in the position shown in FIG. 12B, the base portion 1237 no longer nests in, but rather is separated from, the recess 1212 defined by the safety key 1210. In this position, the safety key 1210 is unlocked and can move laterally between its extended and retracted positions. Preferably, the safety key 1210 does not move to its retracted position in response to being unlocked. To the contrary, an operator preferably must pull the tool (e.g., downwardly) from the tool holder to retract the safety key (once it has been unlocked).

To return the lock assembly of FIG. 12B to the steady state position, the force (F) can be removed. Removing the force (F) allows the spring 1240 to push the transfer member 1235 against the actuator's cam surface, which pushes the actuator 1230 back to its maximally protruding position (limited by back wall 1260). As the spring 1240 is pressing the transfer member 1235 in this manner, a camming shoulder 1239 of the transfer member 1235 bears against (and cams with) the safety key 1210 at an edge or surface of a wall bounding (optionally defining) the recess 1212. This camming action pushes the safety key 1212 toward the extended position until the base portion 1237 of the transfer member nests in the recess 1212, thereby positively locking the safety key 1210 in its extended position. In certain embodiments, the camming shoulder has a generally conical configuration, which optionally tapers (i.e., becomes more narrow) in the general direction of the tool's tip. Thus, the lock assembly of FIGS. 12A-12B operates similarly to that of FIGS. 11A-11D (shown most clearly in FIG. 11D).

Figure 13:
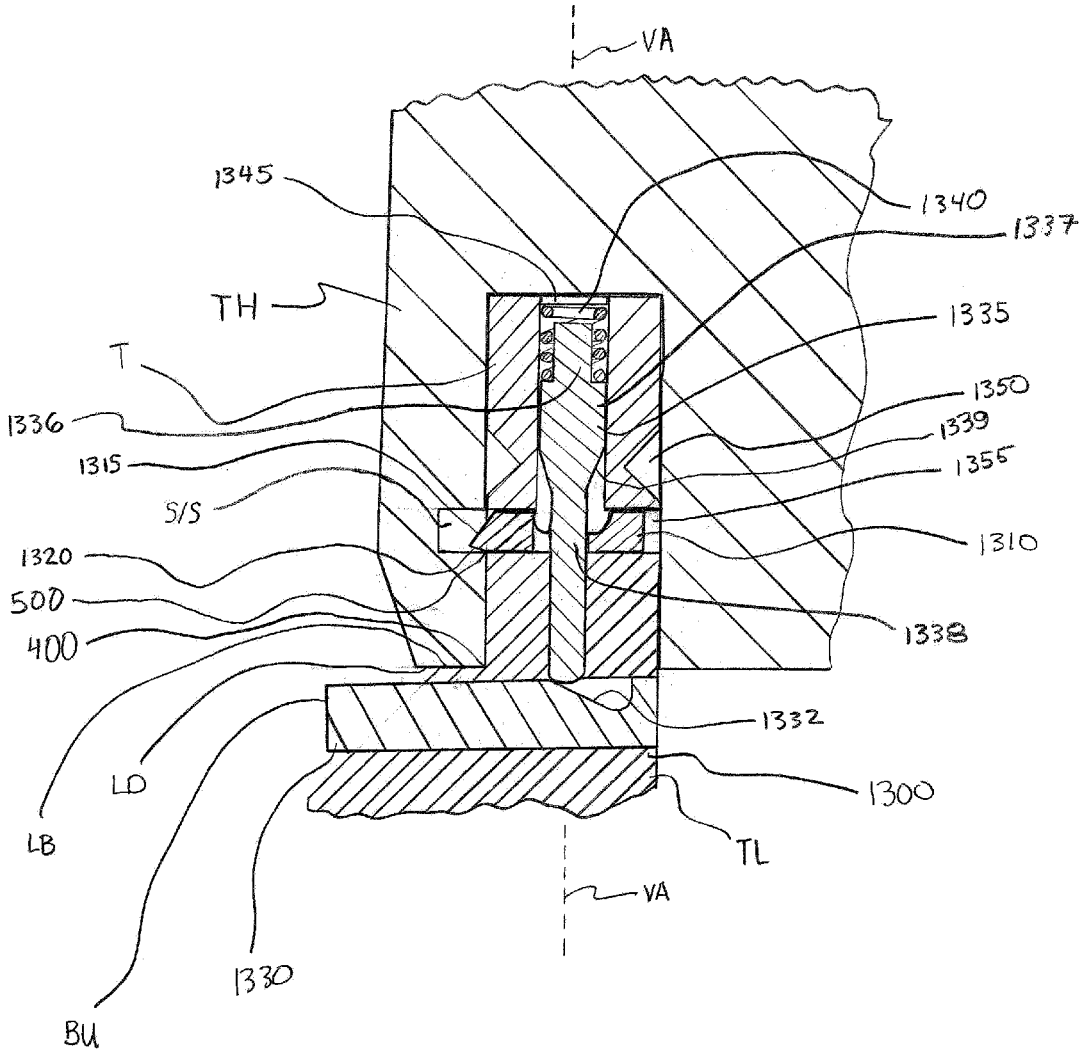
FIG. 13 is a broken-away, cross-sectional view of a press brake tool and a tool holder in combination in accordance with certain embodiments.

One group of embodiments provides a press brake tool and a tool holder in combination. The tool holder can be part of a down-acting press or an up-acting press. In the present embodiments, the tool has a shank mounted in a downwardly-facing recess of the tool holder. Reference is made to FIG. 13. The tool 1300 includes a safety key 1310 having an extended position and a retracted position. In the present embodiments, the safety key 1310 is in its extended position and is received in a safety groove S/S of the tool holder TH. The safety groove S/S is bounded by a generally upwardly-facing shoulder 500 of the tool holder TH. In the present embodiments, the safety key 1310 has a tapered leading region 1315 with a leading cam surface, and a tapered trailing region 1320 with a trailing cam surface. The leading cam surface is offset from vertical by a leading angle, the trailing cam surface is offset from the vertical by a trailing angle, and the leading angle preferably is smaller than the trailing angle. In the present embodiments, the tool includes a lock (e.g., the lock can comprise a transfer member 1335, 1235, 1135) that is in a locked position such that the safety key is positively locked in its extended position. Reference is made to FIG. 12A. Further, in the present group of embodiments, the tool has a button BU that can be pushed by a press brake operator so as to move the lock from its locked position to an unlocked position. In these embodiments, pushing the button (at such time as the clamp of the tool holder has been loosened, in the event the tool holder has a clamp, as in FIG. 8B) results (or can result) in the safety key's trailing cam surface resting on the generally upwardly-facing shoulder 500 (the tool of FIG. 13 is shown in this state) so as to hold/maintain the tool in the tool holder's recess until the operator pulls downwardly on the tool so as to cause the safety key's trailing cam surface to cam with the generally upwardly-facing shoulder 500 thereby moving the safety key from its extended position toward its retracted position and allowing the tool to be removed downwardly from the tool holder's recess. Thus, when the button is pushed and held, the safety key is free to move as it pleases; that is, pushing the button does not cause the safety key to be withdrawn from the safety groove.

In FIG. 13, the illustrated safety groove S/S is a safety slot. However, the safety groove S/S can be a recess like that bounded by shelf 16.3 in FIG. 1A or 8B, or it can be a recess like one of the two uppermost confronting recesses in the tool holder of FIG. 10. Other safety groove configurations can also be used.

In one exemplary embodiment, the spring 1140, 1240, 1340 is a 2-7 pound compression spring having a ⅜ inch diameter and a 7/16 inch length. In one group of embodiments, the tool has a weight of 27 pounds or less. These spring parameters are merely provided as examples. They are by no means limiting to the invention.

For tools weighing over 27 pounds, it may be desirable not to provide a "click-in/click-out" safety key/button assembly of the nature described above. Rather, it may be preferred to use a tool with one or more "click-in/slide-out" safety key assemblies of the nature described in U.S. Pat. No. 7,021,116, entitled "Press Brake Tooling Technology", issued Apr. 4, 2006, the salient contents of which concerning "click-in/slide-out" tools/safety key assemblies are incorporated herein by reference. This way, the tools are dismounted by sliding them lengthwise out of the tool holder's recess, and this may be a desirable safety feature. On the other hand, it is possible for heavier tools having one or more of the features claimed herein to be provided, and the present invention is by no means limited to any particular weight range.

For tools with a length over 500 mm, it may be desirable not to provide a "click-in/click-out" safety key/button assembly of the nature described above. Rather, it may be preferred to use a tool with two or more of the noted "click-in/slide-out" safety key assemblies. Here again, this provides that the tools are dismounted by sliding them lengthwise out of the tool holder, and this can be a desirable safety feature. It is possible, however, for longer tools having one or more of the features claimed herein to be provided, and the present invention is by no means limited to any particular length range.

In some embodiments, a tool with a length of less than 500 mm and greater than 100 mm is provided with two "click-in/click-out" safety key/button assemblies. These two safety key/button assemblies can advantageously be located about 25 mm from the two respective ends of the tool. Further, some embodiments provide that tools having a length of 100 mm or shorter can advantageously be provided with a single "click-in/click-out" safety key/button assembly. These parameters, however, are merely provided by way of example—they are not limiting to the invention.

One exemplary group of embodiments involves a tool height of about 120 mm. In this embodiment group, the tool is provided with a single "click-in/click-out" safety key/button assembly for all lengths of the tool, unless the tool's weight exceeds 27 pounds, in which case the tool is provided with one or more of the noted "click-in/slide-out" safety key assemblies. Again, these parameters are merely examples. They are not limiting to the invention.

Another exemplary group of embodiments involves a tool height of 220 mm. In this group, the tool is provided with a single "click-in/click-out" safety key/button assembly for all lengths of the tool of 100 mm or less (due to ease of handling), unless the tool's weight exceeds 27 pounds, in which case the tool is provided with one or more "click-in/slide-out" safety key assemblies. Here again, the noted parameters are simply examples. They are by no means required.

While preferred embodiments of the present invention have been described, it should be understood that a variety of changes, adaptations, and modifications can be made therein without departing from the spirit of the invention and the scope of the appended claims.

What is claimed is:

1. A press brake tool and a tool holder in combination, the tool holder including a downwardly-facing recess, a safety groove, and a generally upwardly-facing shoulder, the tool having a shank mounted in the downwardly-facing recess of the tool holder, the tool including a safety key having an extended position and a retracted position, the safety key being in its extended position and being received in the safety groove of the tool holder, the safety groove being bounded by the generally upwardly-facing shoulder of the tool holder, the safety key having (a) a tapered leading region with a leading cam surface, and (b) a tapered trailing region with a trailing cam surface, the leading cam surface being offset from vertical by a leading angle, the trailing cam surface being offset from vertical by a trailing angle, the leading angle being smaller than the trailing angle, the tool including a lock that is in a locked position in which the lock engages the safety key to positively lock it in its extended position, the tool having a button that can be pushed by a press brake operator, wherein pushing the button forces the lock from its locked position to an unlocked position and results in the safety key's trailing cam surface resting on said generally upwardly-facing shoulder so as to hold the tool in the tool holder's recess until the operator pulls downwardly on the tool so as to cause the safety key's trailing cam surface to cam with said generally upwardly-facing shoulder thereby moving the safety key from its extended position toward its retracted position and allowing the tool to be removed downwardly from the tool holder's recess.

2. A press brake tool that is adapted to be mounted in a recess of a tool holder, the press brake tool comprising:

a safety key having an extended position and a retracted position, the safety key including (a) a tapered leading region defining a leading cam surface that is adapted to cam with a first surface of the tool holder when the tool is inserted vertically into the recess thereby moving the safety key from its extended position to its retracted position and (b) a tapered trailing region defining a trailing cam surface that is adapted to cam with a second surface of the tool holder when the tool is removed vertically from the recess thereby moving the safety key from its extended position to its retracted position, the leading cam surface being offset from vertical by a leading angle, the trailing cam surface being offset from vertical by a trailing angle, the leading and trailing angles being different.

3. The press brake tool of claim 2, wherein the tool includes a lock that is movable between (a) a locked position wherein the safety key is positively locked in its extended position and (b) an unlocked position wherein the safety key is permitted to move between its extended position and its retracted position.

4. The press brake tool of claim 2, wherein the leading angle is smaller than the trailing angle.

5. The press brake tool of claim 2, wherein the leading cam surface forms an acute, positive angle with horizontal.

6. The press brake tool of claim 2, wherein the leading cam surface forms an angle with horizontal between about 50° and about 60°.

7. The press brake tool of claim 2, wherein the trailing cam surface forms an acute, negative angle with horizontal.

8. The press brake tool of claim 2, wherein the trailing cam surface forms an angle with horizontal between about −15° and about −25°.

9. The press brake tool of claim 2, wherein said first surface of the tool holder against which the tapered leading region is configured to cam is defined by a generally downwardly-oriented shoulder of the tool holder, and wherein said second surface of the tool holder against which the tapered trailing region is configured to cam is defined by a generally upwardly-oriented shoulder of the tool holder.

10. A press brake tool with a shank on which there is provided a safety key having an extended position and a retracted position, the safety key defining a recess and an aperture, wherein the aperture extends through the safety key and is within the recess, the tool having a lock assembly adapted for positively locking the safety key in its extended position, the lock assembly comprising:

a transfer member having a base portion and an extending portion, the extending portion passing through the aperture defined by the safety key;

an actuator operable to move the transfer member from (a) a locked position in which the base portion of the transfer member nests in the recess defined by the safety key, the safety key being positively locked in its extended position when the transfer member is in its locked position, to (b) an unlocked position in which the base portion is separated from the recess defined by the safety key, the safety key being permitted to move between its extended and retracted positions when the transfer member is in its unlocked position.

11. The press brake tool of claim 10, wherein the recess defined by the safety key is bounded by a generally U-shaped surface of the safety key.

12. The press brake tool of claim 10, wherein the aperture extends entirely through the safety key, and wherein the safety key entirely surrounds the extending portion of the transfer member.

13. The press brake tool of claim 10, wherein the tool includes a biasing member coupled to the transfer member, the biasing member being configured to bias the transfer member toward its locked position.

14. The press brake tool of claim 13, wherein the biasing member comprises a spring coupled to the transfer member, the spring biasing the transfer member generally toward a workpiece-engagement tip of the tool.

15. The press brake tool of claim 10, wherein the transfer member includes a camming shoulder configured to cam with the safety key such that movement of the transfer member toward its locked position, at such time as the safety key is in its retracted position, causes the camming shoulder of the transfer member to cam with the safety key thereby moving the safety key toward its extended position.

16. The press brake tool of claim 15, wherein the base portion includes a generally cylindrical portion, and wherein the camming shoulder has a generally conical configuration.

17. The press brake tool of claim 16, wherein the extending portion has a generally rod-shaped configuration with a smaller diameter than the base portion.

18. The press brake tool of claim 10, wherein the tool's shank includes a wall and when the transfer member is in its locked position the safety key is positively locked in its extended position by virtue of the transfer member being rigidly lodged between the safety key and the wall of the tool's shank.

19. The press brake tool of claim 10, wherein the safety key includes (a) a tapered leading region defining a leading cam surface offset from vertical by a leading angle, and (b) a tapered trailing region defining a trailing cam surface offset from vertical by a trailing angle, wherein the leading angle is smaller than the trailing angle.

20. A press brake tool that is adapted to be mounted in a recess of a tool holder, the press brake tool comprising:

(a) a safety key having an extended position and a retracted position, the safety key defining a recess and an aperture, wherein the aperture extends through the safety key and is within the recess, the safety key including:

(i) a tapered leading region that comprises a generally planar surface, which forms an acute, positive angle with horizontal, and (ii) a tapered trailing region that comprises a generally planar surface, which forms an acute, negative angle with horizontal; and (b) a lock assembly including:

(i) a transfer member having a base portion and an extending portion, the extending portion passing through the aperture defined by the safety key, (ii) an actuator having a cam surface configured to cam with the extending portion of the transfer member such that a desired movement of the actuator causes the transfer member to move from (A) a locked position in which the base portion of the transfer member nests in the recess defined by the safety key, the safety key being positively locked in its extended position when the transfer member is in its locked position, to (B) an unlocked position in which the base portion of the transfer member is separated from the recess defined by the safety key, the safety key being permitted to move between its extended and retracted positions when the transfer member is in its unlocked position, and (iii) a spring configured to bias the transfer member toward its locked position.

* * * * *

UNITED STATES PATENT AND TRADEMARK OFFICE

CERTIFICATE OF CORRECTION

PATENT NO. : 7,661,288 B2
APPLICATION NO. : 11/616602
DATED : February 16, 2010
INVENTOR(S) : Shimota et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 479 days.

Signed and Sealed this

Thirtieth Day of November, 2010

David J. Kappos

David J. Kappos
*Director of the United States Patent and Trademark Office*